US011247469B2

(12) United States Patent
Taniuchi et al.

(10) Patent No.: US 11,247,469 B2
(45) Date of Patent: Feb. 15, 2022

(54) LIQUID EJECTION HEAD AND LIQUID EJECTION APPARATUS

(71) Applicant: Seiko Epson Corporation, Tokyo (JP)

(72) Inventors: Akinori Taniuchi, Matsumoto (JP); Masahiro Asami, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/081,212

(22) Filed: Oct. 27, 2020

(65) Prior Publication Data

US 2021/0122158 A1 Apr. 29, 2021

(30) Foreign Application Priority Data

Oct. 28, 2019 (JP) ..... JP2019-195412

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2002/14241; B41J 2002/14419; B41J 2002/14491; B41J 2/14233; B41J 2202/12; B41J 2002/14475; B41J 2/14201; B41J 2/01
See application file for complete search history.

(56) References Cited

U.S. PATENT DOCUMENTS

2018/0154652 A1* 6/2018 Yazaki ..... B41J 2/055

FOREIGN PATENT DOCUMENTS

JP 2018-089860 A 6/2018

* cited by examiner

*Primary Examiner* — Bradley W Thies
(74) *Attorney, Agent, or Firm* — Harness, Dickey & Pierce, P.L.C.

(57) ABSTRACT

The second width is smaller than the first width and the fourth width is larger than the third width.

22 Claims, 8 Drawing Sheets

LIQUID EJECTION HEAD AND LIQUID EJECTION APPARATUS

The present application is based on, and claims priority from JP Application Serial Number 2019-195412, filed Oct. 28, 2019, the disclosure of which is hereby incorporated by reference herein in its entirety.

BACKGROUND

1. Technical Field

The present disclosure relates to a liquid ejection head and a liquid ejection apparatus.

2. Related Art

In the related art, there is a technique in which, of a flow path portion forming a nozzle for ejecting a liquid from a liquid ejection head, a flow path portion coupled upstream of a flow path portion including an opening end is provided so as to be thicker than that portion (JP-A-2018-89860). A cross-sectional area of the flow path portion located upstream in the nozzle is increased, and thus the liquid can be efficiently supplied from the flow path further upstream to the nozzle. On the other hand, a cross-sectional area of the flow path portion located at the opening end is reduced in the nozzle, and thus the liquid can be more stably ejected from the opening of the nozzle in a direction perpendicular to an opening end face.

However, when there are the portions having different cross-sectional areas in the flow path portion in the nozzle, the liquid may be retained at a step formed in the coupling portion. In the flow path portion in the nozzle, the liquid located near a central axis of the flow path is pushed by the liquid supplied from the flow path further upstream, moves toward the nozzle opening, and is ejected from the opening. On the other hand, the liquid located near an inner wall of the flow path portion in the nozzle is hindered from moving downstream due to the step of the inner wall between the downstream portion and the upstream portion, and is not efficiently ejected from the nozzle opening. As a result, the liquid is retained in the nozzle for a long time. The liquid in the nozzle deteriorates over time. Therefore, such a liquid causes a deterioration in the quality of the liquid ejected from the nozzle. A coloring material or resin of a liquid ink retained in the nozzle solidifies and accumulates, which may cause ejection failure of the liquid from the nozzle.

SUMMARY

According to an aspect of the present disclosure, a liquid ejection head is provided. The liquid ejection head includes a flow path for a liquid to flow in a first direction, an energy generation element that generates energy for ejecting the liquid, and a nozzle that communicates with the flow path and that ejects the liquid in an ejection direction that intersects the first direction by the energy generated by the energy generation element.

A specific position in the nozzle in the ejection direction is a first position, a specific position in the nozzle that is downstream of the first position in the ejection direction is a second position, a substantially center in the nozzle in a second direction that is a direction intersecting the first direction and the ejection direction is a third position, a specific position in the nozzle in the first direction is a fourth position, and a specific position in the nozzle that is closer to one end of the nozzle in the first direction than is the fourth position is a fifth position.

A width of the nozzle in the first direction at a position where the position in the ejection direction is the first position and the position in the second direction is the third position is a first width, a width of the nozzle in the first direction at a position where the position in the ejection direction is the second position and the position in the second direction is the third position is a second width, a width of the nozzle in the second direction at a position where the position in the ejection direction is the second position and the position in the first direction is the fourth position is a third width, and a width of the nozzle in the second direction at a position where the position in the ejection direction is the second position and the position in the first direction is the fifth position is a fourth width.

The second width is smaller than the first width and the fourth width is larger than the third width.

DESCRIPTION OF EXEMPLARY EMBODIMENTS

Figure 1:
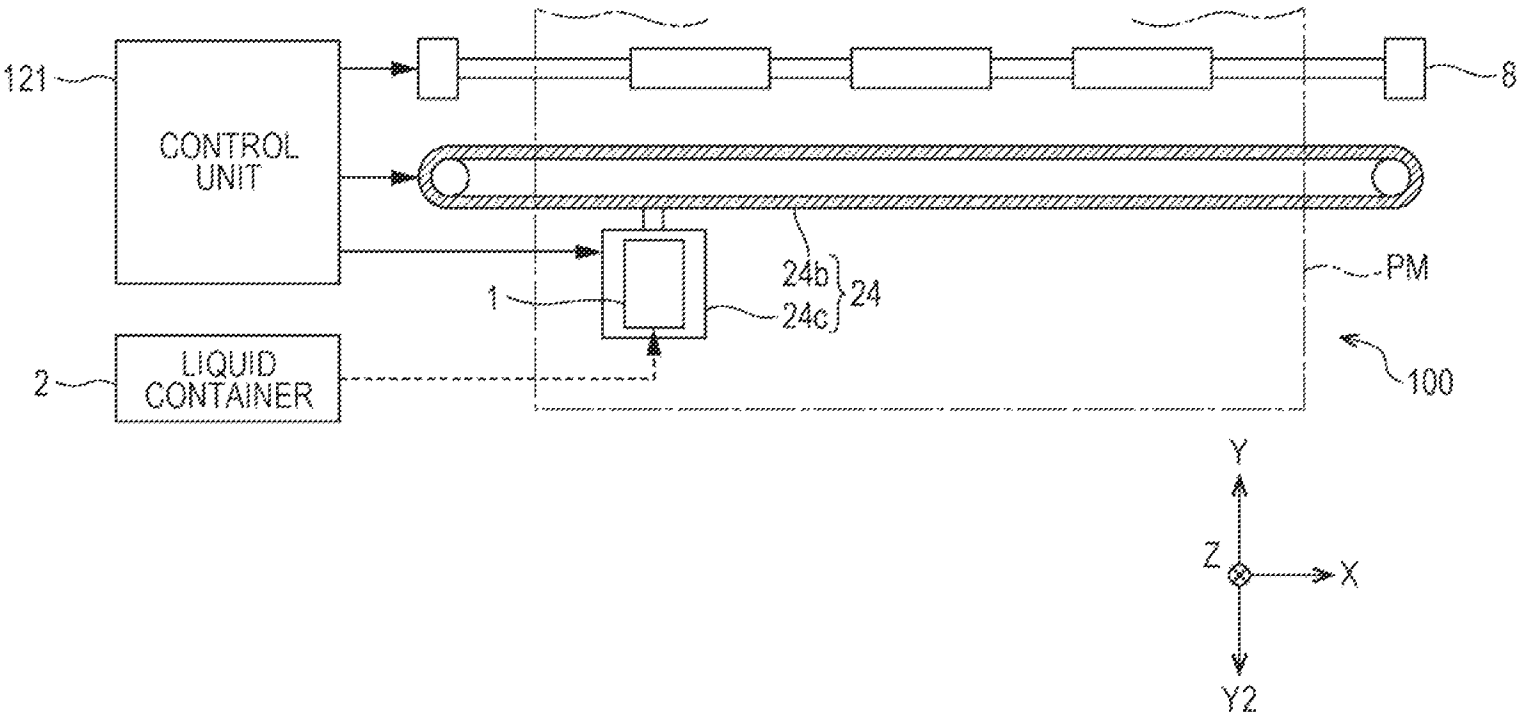
FIG. 1 is an explanatory diagram showing a liquid ejection apparatus 100 according to a first embodiment.

A. First Embodiment:

A1. Configuration of Liquid Ejection Apparatus:

1. Mechanical Configuration of Liquid Ejection Apparatus:

FIG. 1 is an explanatory diagram showing a liquid ejection apparatus 100 according to a first embodiment. The liquid ejection apparatus 100 is an ink jet printing apparatus that ejects liquid ink onto a medium PM. In the liquid ejection apparatus 100, a liquid container 2 that stores the ink can be mounted and the medium PM can be set. The liquid ejection apparatus 100 can eject the ink in the liquid container 2 toward the medium PM. The liquid ejection apparatus 100 includes a liquid ejection head 1, a moving mechanism 24, a transport mechanism 8, and a control unit 121.

The liquid ejection head 1 includes a plurality of nozzles. The liquid ejection head 1 ejects, from the plurality of nozzles, the liquid ink supplied from the liquid container 2. The ink ejected from the nozzle lands on the medium PM disposed at a predetermined position. A configuration of the liquid ejection head 1 will be described below in detail.

The moving mechanism 24 includes an annular belt 24*b* and a carriage 24*c* fixed to the belt 24*b* and capable of holding the liquid ejection head 1. The moving mechanism 24 rotates the annular belt 24*b* in both directions and thus can reciprocate the liquid ejection head 1 in an X direction.

The transport mechanism 8 transports the medium PM along a negative Y direction during a plurality of movements of the liquid ejection head 1 by the moving mechanism 24. A Y direction is a direction orthogonal to the X direction. However, the Y direction may not necessarily be orthogonal to the X direction, and for example, the Y direction may intersect the X direction at an angle of 85 degrees to 89 degrees. As a result, the ink ejected toward a virtual surface stretched in the X and Y directions forms an image on the medium PM. In FIG. 1, the negative Y direction in which the medium PM is transported is indicated by an arrow Y2.

A direction perpendicular to the X and Y directions is a Z direction. However, the Z direction may not necessarily be perpendicular to the X and Y directions, and for example, the Z direction may intersect the X direction at an angle of 85 degrees to 89 degrees and may intersect the Y direction at an angle of 85 to 89 degrees. The liquid ejection head 1 ejects the ink along the Z direction while being transported along the X direction.

The control unit 121 controls an ink ejection operation from the liquid ejection head 1. The control unit 121 controls the transport mechanism 8, the moving mechanism 24, and the liquid ejection head 1 to form the image on the medium PM.

Figure 2:
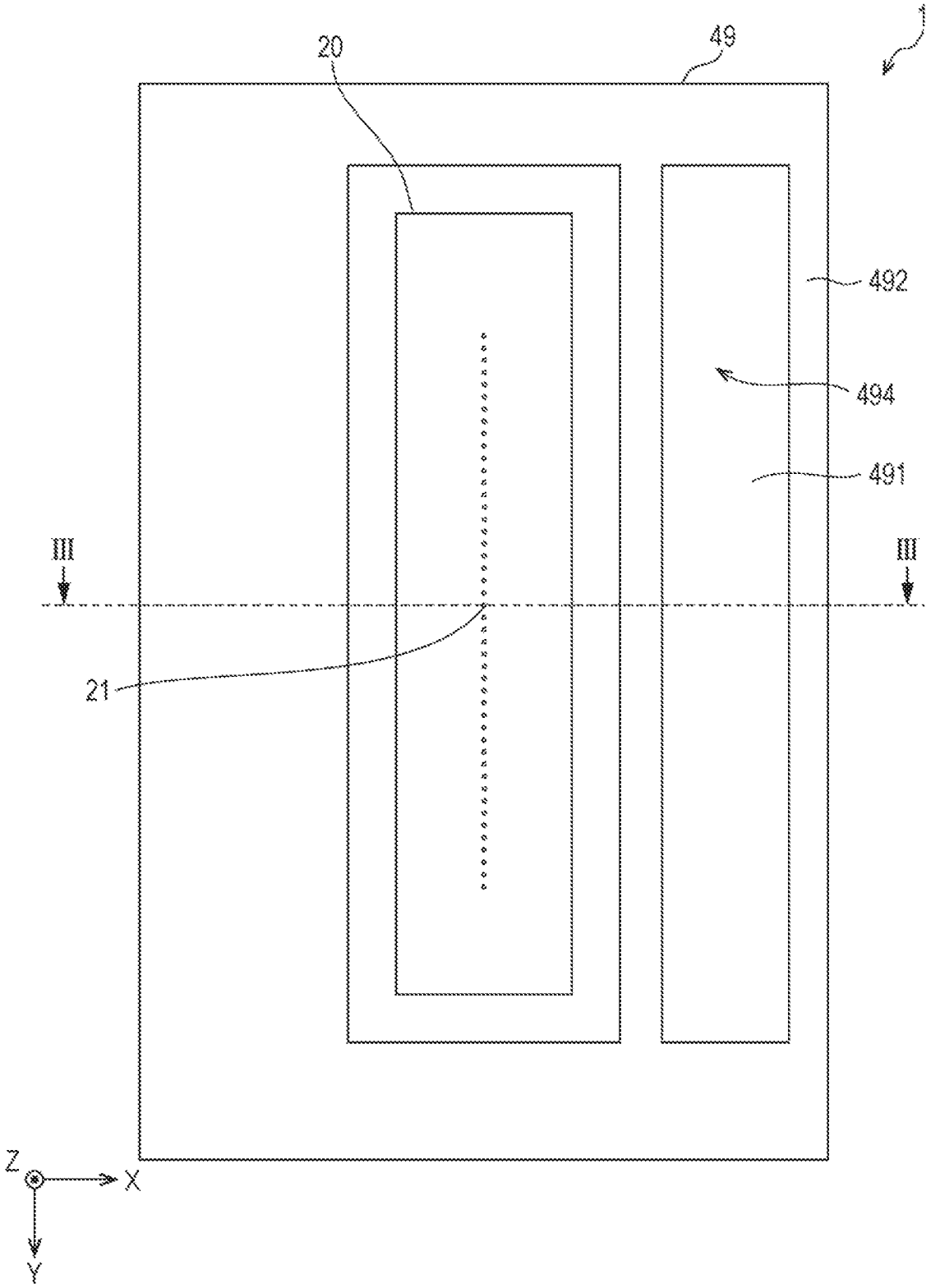
FIG. 2 is a plan view of a liquid ejection head 1.

FIG. 2 is a plan view of the liquid ejection head 1. The liquid ejection head 1 according to the embodiment is an ink jet recording head. The liquid ejection head 1 ejects an ink droplet from a nozzle 21. The nozzles 21 are linearly disposed along the Y direction in a nozzle plate 20 disposed parallel to an XY plane.

Figure 3:
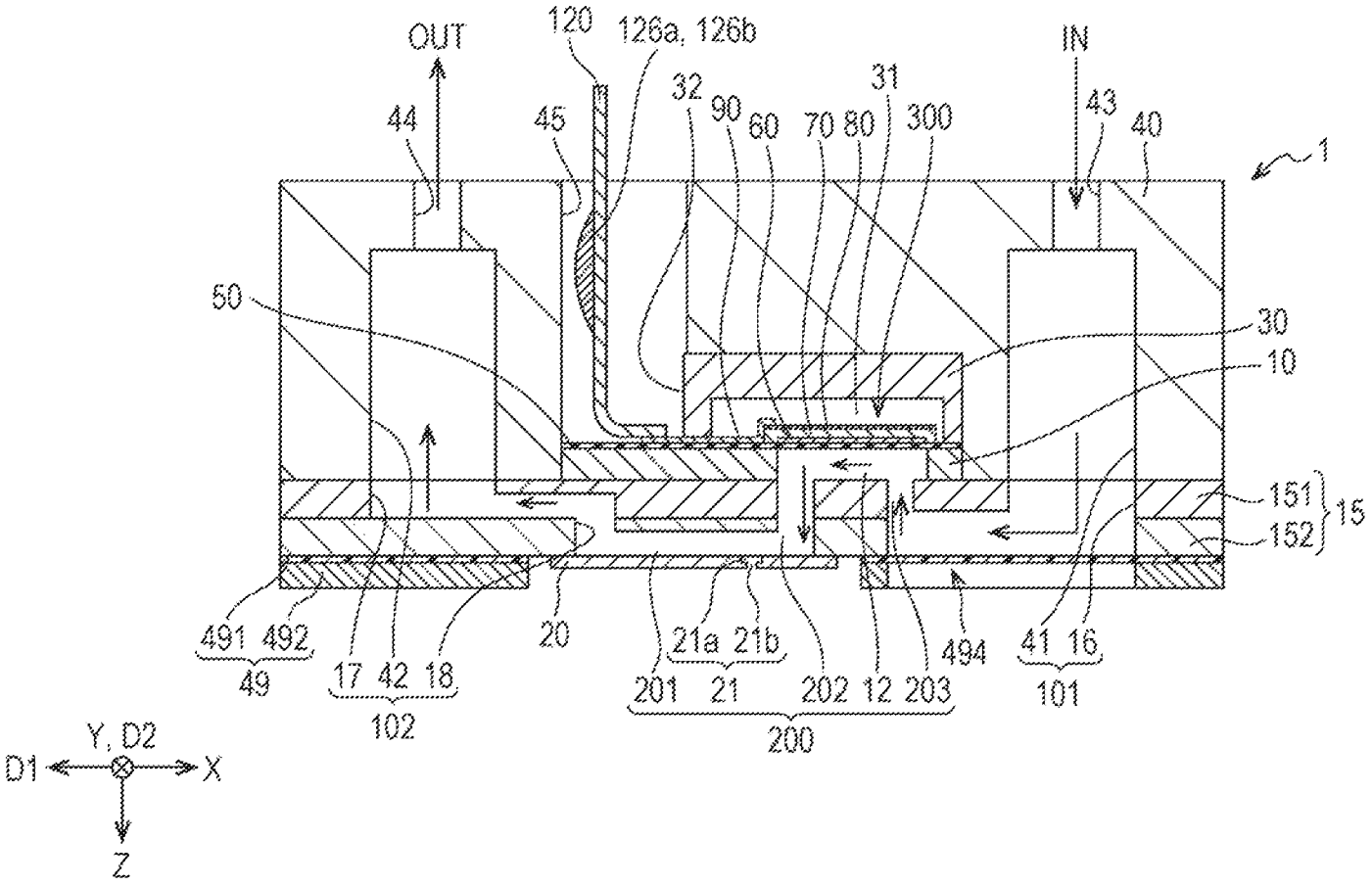
FIG. 3 is a cross-sectional view taken along a line III-III in FIG. 2.

FIG. 3 is a cross-sectional view taken along a line III-III in FIG. 2. The liquid ejection head 1 includes a flow path forming substrate 10, a communication plate 15, the nozzle plate 20, a compliance substrate 49, a vibration plate 50, a piezoelectric actuator 300, a protective substrate 30, and a case member 40.

The flow path forming substrate 10 is made of a silicon single crystal substrate. The flow path forming substrate 10 includes a plurality of pressure chambers 12 (refer to the lower center in FIG. 3). The plurality of pressure chambers 12 are disposed side by side along the Y direction. One pressure chamber 12 communicates with one nozzle 21. Two pressure chambers 12 disposed adjacent to each other in the Y direction are separated by a partition which is a part of the flow path forming substrate 10.

The communication plate 15 is disposed in contact with the flow path forming substrate 10 on a positive side in the Z direction with respect to the flow path forming substrate 10. The communication plate 15 has a first communication plate 151 and a second communication plate 152. The first communication plate 151 and the second communication plate 152 are disposed in the Z direction in an order of the first communication plate 151 and the second communication plate 152. The first communication plate 151 and the second communication plate 152 are each made of a silicon single crystal substrate.

The communication plate 15 has one first communication section 16, one second communication section 17, one third communication section 18, a plurality of first flow paths 201, a plurality of second flow paths 202, and a plurality of supply paths 203.

The first communication section 16 is one void provided in the first communication plate 151 and the second communication plate 152 (refer to the lower right part in FIG. 3). The first communication section 16 communicates with a first liquid chamber section 41 of the case member 40. The first communication section 16 communicates with the plurality of pressure chambers 12 through the plurality of supply paths 203 provided in the first communication plate 151 and the second communication plate 152. One supply path 203 communicates with one pressure chamber 12.

The second communication section 17 is one void provided in the first communication plate 151 (refer to the lower left part in FIG. 3). The second communication section 17 communicates with a second liquid chamber section 42 of the case member 40. The second communication section 17 communicates with the third communication section 18.

The third communication section 18 is one void provided in the first communication plate 151 and the second communication plate 152 (refer to the lower central part in FIG. 3). The third communication section 18 communicates with the second communication section 17. The third communication section 18 communicates with the plurality of pressure chambers 12 through a plurality of sets of first flow paths 201 and second flow paths 202 provided in the second communication plate 152. A pair of first flow path 201 and second flow path 202 communicates with one pressure chamber 12.

In the communication plate 15, the ink passes through the supply path 203, the pressure chamber 12, the second flow path 202, and the first flow path 201 from the first communication section 16 and reaches the third communication section 18. The supply path 203, the pressure chamber 12, the second flow path 202, and the first flow path 201 are collectively referred to as an individual flow path 200. One individual flow path 200 is coupled to one nozzle 21. In FIG. 3, a direction in which the ink flows is indicated by an arrow disposed in the void.

The nozzle plate 20 is disposed in contact with the communication plate 15 on the positive side in the Z direction with respect to the communication plate 15 (refer to the lower part in FIG. 3). The nozzle plate 20 is a stainless steel plate material. The nozzle plate 20 blocks the first flow path 201, the second flow path 202, and the third communication section 18, each of which is open to the positive side in the Z direction of the communication plate 15, on the positive side in the Z direction of the communication plate 15.

The nozzle plate 20 includes the nozzle 21 in a portion that blocks the first flow path 201. The nozzles 21 are linearly disposed along the Y direction in the nozzle plate 20 disposed parallel to the XY plane (refer to FIG. 2).

The compliance substrate 49 is disposed in contact with the communication plate 15 on the positive side in the Z direction with respect to the communication plate 15 (refer to the lower part in FIG. 3). The compliance substrate 49 blocks the first communication section 16 that is open to the positive side in the Z direction of the communication plate 15 on the positive side in the Z direction (refer to the lower right part in FIG. 3). The compliance substrate 49 has a sealing film 491 and a fixed substrate 492. The sealing film 491 and the fixed substrate 492 are disposed in the Z direction in an order of the sealing film 491 and the fixed substrate 492.

The sealing film 491 is a flexible thin film. The fixed substrate 492 is made of a metal material. A portion of the compliance substrate 49 that seals the first communication section 16 of the communication plate 15 is provided with the sealing film 491, but not the fixed substrate 492 (refer to the lower right part in FIG. 3). The sealing film 491 that seals the first communication section 16 of the communication plate 15 elastically deforms to reduce a pressure fluctuation in the first communication section 16. The portion of the compliance substrate 49 that seals the first communication section 16 of the communication plate 15 is also referred to as a compliance section 494.

The vibration plate 50 is disposed in contact with the flow path forming substrate 10 on a negative side in the Z direction with respect to the flow path forming substrate (refer to the central part in FIG. 3). The vibration plate 50 has a single-layer structure or a laminated structure selected from a silicon dioxide layer and a zirconium oxide layer. The vibration plate 50 blocks the pressure chamber 12 that is open to the negative side in the Z direction of the flow path forming substrate 10 on the negative side in the Z direction of the flow path forming substrate 10.

The piezoelectric actuator 300 is disposed in contact with the vibration plate 50 on the negative side in the Z direction with respect to the vibration plate 50 (refer to the central part in FIG. 3). A plurality of piezoelectric actuators 300 are respectively provided at positions facing the plurality of pressure chambers 12 with the vibration plate 50 interposed therebetween. The piezoelectric actuator 300 has a first electrode 60, a piezoelectric layer 70, and a second electrode 80. The first electrode 60, the piezoelectric layer 70, and the second electrode 80 are disposed in the negative Z direction in an order of the first electrode 60, the piezoelectric layer 70, and the second electrode 80.

Lead electrodes 90 are respectively coupled to the second electrodes 80 (refer to the central part in FIG. 3). A voltage is selectively applied to each piezoelectric actuator 300 through the lead electrode 90. When the voltage is applied to the piezoelectric layer 70 by the first electrode 60 and the second electrode 80, the piezoelectric layer 70 deforms. The vibration plate 50 disposed in contact with the piezoelectric actuator 300 is deformed by the deformation of the piezoelectric layer 70 and applies pressure to the ink in the pressure chamber 12. As a result, the pressure is transmitted to the ink in the first flow path 201 through the ink in the second flow path 202, and the ink is ejected from the nozzle 21. The application of pressure to the ink in the pressure chamber 12 can be interpreted as the application of kinetic energy generated by the piezoelectric actuator 300 to the ink in the pressure chamber 12.

A part of the protective substrate 30 is disposed in contact with the vibration plate 50 on the negative side in the Z direction with respect to the vibration plate 50 (refer to the central part in FIG. 3). The protective substrate 30 is made of a silicon single crystal substrate. The protective substrate 30 has a piezoelectric actuator holding section 31 that accommodates the plurality of piezoelectric actuators 300. The piezoelectric actuator holding section 31 is one recessed portion that is open to the negative side in the Z direction. The plurality of piezoelectric actuators 300 can be deformed in the piezoelectric actuator holding section 31.

A part of the vibration plate 50 and a part of the lead electrode 90 are exposed without being covered by the protective substrate 30 (refer to the central part in FIG. 3). The part of the exposed lead electrode 90 is coupled to a flexible cable 120. The flexible cable 120 is a flexible wiring substrate. The flexible cable 120 includes drive circuits **126*a* and 126*b*** which are semiconductor elements.

The case member 40 is disposed in contact with the communication plate 15 and the protective substrate 30 on the negative side in the Z direction with respect to the communication plate 15 and the protective substrate 30 (refer to the upper part in FIG. 3). The case member 40 includes the first liquid chamber section 41, the second liquid chamber section 42, an inlet 43, an outlet 44, and a coupling hole 45.

The first liquid chamber section 41 is one recessed portion that is open to the Z direction side (refer to the upper right part in FIG. 3). The first liquid chamber section 41 communicates with the first communication section 16 of the communication plate 15. The first liquid chamber section 41 of the case member 40 and the first communication section 16 of the communication plate 15 form a first common liquid chamber 101. The inlet 43 communicates the first liquid chamber section 41 with a temporary storage section provided outside the liquid ejection head 1. The temporary storage section is not shown in FIG. 3 to facilitate understanding of the technique.

The second liquid chamber section 42 is one recessed portion that is open to the Z direction side (refer to the upper left part in FIG. 3). The second liquid chamber section 42 communicates with the second communication section 17 of the communication plate 15. The second liquid chamber section 42 of the case member 40, the second communication section 17, and the third communication section 18 of the communication plate 15 form a second common liquid chamber 102. The outlet 44 communicates the second liquid chamber section 42 with the temporary storage section.

In the case member 40, the ink is introduced from the inlet 43, passes through the first liquid chamber section 41, and is supplied to the communication plate 15 (refer to the arrow IN on the upper right part in FIG. 3). The ink supplied from the communication plate 15 passes through the second liquid chamber section 42 and is discharged from the outlet 44 to the temporary storage section (refer to the arrow OUT on the upper left part in FIG. 3).

The ink discharged to the temporary storage section is introduced again from the inlet 43. That is, the ink circulates between the liquid ejection head 1 and the temporary storage chamber provided outside the liquid ejection head 1 in the present embodiment.

The coupling hole 45 is a hole penetrating the case member 40 in the Z direction (refer to the upper center part in FIG. 3). The part of the exposed lead electrode 90 is coupled to the flexible cable 120 disposed through the coupling hole 45.

Figure 4:
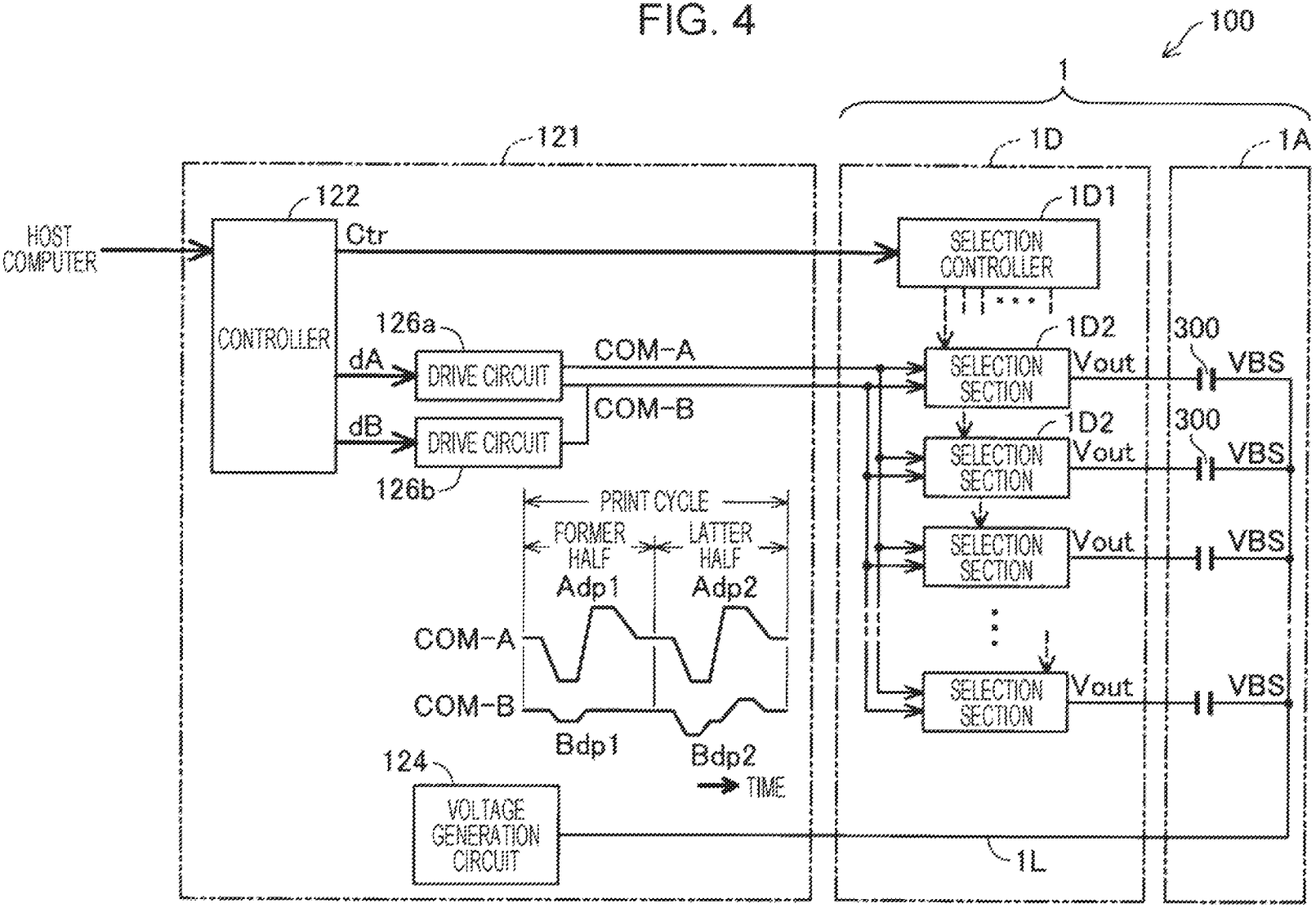
FIG. 4 is a block diagram showing an electrical configuration of the liquid ejection apparatus 100.

2. Electrical Configuration of Liquid Ejection Apparatus 100:

FIG. 4 is a block diagram showing an electrical configuration of the liquid ejection apparatus 100. The control unit 121 applies an electric signal to the piezoelectric actuator 300 of the liquid ejection head 1 to control driving of the piezoelectric actuator 300. The control unit 121 can execute a first control that drives the piezoelectric actuator 300 such that the liquid is ejected from the nozzle 21 and a second control that drives the piezoelectric actuator 300 such that the liquid is not ejected from the nozzle 21. With such control, the ink can flow in the nozzle 21 even in a time interval in which the ink is not ejected from the nozzle 21. As a result, it is possible to prevent a situation in which some of the ink retains in the nozzle 21 for a long period of time. The electrical configuration and function of the liquid ejection apparatus 100 will be described below in detail.

The control unit 121 supplies a control signal Ctr, drive signals COM-A and COM-B, and a holding signal of a voltage VBS to the liquid ejection head 1 (refer to the upper left part in FIG. 4). The liquid ejection head 1 drives the piezoelectric actuator 300 according to the control signal Ctr, the drive signals COM-A and COM-B, and the voltage VBS received from the control unit 121 to eject the ink from the nozzle 21.

The control unit 121 includes a controller 122, the drive circuits 126*a* and 126*b*, and a voltage generation circuit 124. The controller 122 is a microcomputer having a CPU, a RAM, a ROM, or the like (refer to the upper left part in FIG. 4). The controller 122 executes a predetermined program by the CPU and thus can output various control signals for controlling each part of the liquid ejection apparatus 100 based on image data.

The controller 122 controls the moving mechanism 24 and the transport mechanism 8 (refer to FIG. 1). The controller 122 supplies various control signals Ctr to the liquid ejection head 1 in synchronization with the control of the moving mechanism 24 and the transport mechanism 8 (refer to the upper part in FIG. 4). The control signal Ctr includes print data that defines an amount of ink ejected from the nozzle 21, a clock signal that is used to transfer the print data, a timing signal that defines a print cycle, and the like. The controller 122 repeatedly supplies digital data dA to the drive circuit 126*a* (refer to the upper left part in FIG. 4). The controller 122 repeatedly supplies digital data dB to the drive circuit 126*b*.

The drive circuit 126*a* converts the data dA into an analog signal, further amplifies the converted signal, and outputs the amplified signal as the drive signal COM-A to the liquid ejection head 1 (refer to the upper left part in FIG. 4). The drive circuit 126*b* converts the data dB into an analog signal, further amplifies the converted signal, and outputs the amplified signal as the drive signal COM-B to the liquid ejection head 1. The drive circuits 126*a* and 126*b* have the same hardware configuration.

In the present embodiment, ink droplets are ejected from one nozzle 21 at most twice during the print cycle corresponding to one pixel. The ink droplets are combined to express four gradations of a large dot, a medium dot, a small dot, and non-recording in the one pixel.

The drive signal COM-A has a trapezoidal waveform Adp1 disposed in a former half period of the print cycle and a trapezoidal waveform Adp2 disposed in a latter half period of the print cycle (refer to the lower central part in FIG. 4). The trapezoidal waveforms Adp1 and Adp2 are substantially the same waveform. The trapezoidal waveforms Adp1 and Adp2 are waveforms for respectively ejecting a medium amount of ink from the nozzle 21 corresponding to the piezoelectric actuator 300 when the trapezoidal waveforms are respectively supplied to the individual electrodes of the piezoelectric actuator 300.

The drive signal COM-B has a trapezoidal waveform Bdp1 disposed in the former half period of the print cycle and a trapezoidal waveform Bdp2 disposed in the latter half period of the print cycle (refer to the lower central part in FIG. 4). The trapezoidal waveforms Bdp1 and Bdp2 are different waveforms. The trapezoidal waveform Bdp1 is a waveform for slightly vibrating the ink near the nozzle 21 to prevent the viscosity of the ink from increasing. When the trapezoidal waveform Bdp1 is supplied to the individual electrodes of the piezoelectric actuator 300, the ink droplets are not ejected from the nozzle 21 corresponding to the piezoelectric actuator 300. When the trapezoidal waveform Bdp2 is supplied to individual electrodes of the piezoelectric actuator 300, the trapezoidal waveform Bdp2 is a waveform for ejecting smaller amount of ink than the trapezoidal waveforms Adp1 and Adp2 from the nozzle 21 corresponding to the piezoelectric actuator 300.

When a large dot is required to be formed in a certain pixel, the drive signal COM-A is selected in the former half and the latter half of the print cycle. The signal is supplied to the individual electrodes of the piezoelectric actuator 300 to be driven (refer to the left side of the piezoelectric actuator 300 in FIG. 4 and the second electrode 80 in FIG. 3). As a result, a medium amount of ink droplets is ejected twice. The inks of the ink droplets coalesce on the medium PM to form the large dot.

When a medium dot is required to be formed in a certain pixel, the drive signal COM-A is selected in the former half of the print cycle and the drive signal COM-B is selected in the latter half of the print cycle. The signals are supplied to the individual electrodes of the piezoelectric actuator 300 to be driven. That is, the trapezoidal waveform Adp1 and the trapezoidal waveform Bdp2 are selected and supplied to the individual electrodes of the piezoelectric actuator 300. As a result, medium and small ink droplets are ejected. The inks of the ink droplets coalesce on the medium PM to form the medium dot.

When a small dot is required to be formed in a certain pixel, neither of the drive signals COM-A and COM-B is selected in the former half of the print cycle, and the drive signal COM-B is selected in the latter half of the print cycle. The signal is supplied to the individual electrodes of the piezoelectric actuator 300 to be driven. That is, the trapezoidal waveform Bdp2 is selected and supplied to the individual electrodes of the piezoelectric actuator 300. As a result, a small amount of ink is ejected once to form the small dot on the medium PM.

The control of the piezoelectric actuator 300 when the large dot, the medium dot, or the small dot is required to be formed in the pixel described above is the "first control".

When a dot is not recorded in a certain pixel, the drive signal COM-B is selected in the former half of the print cycle and neither of the drive signals COM-A and COM-B is selected in the latter half of the print cycle. The signal is supplied to the individual electrodes of the piezoelectric actuator 300 to be driven. That is, the trapezoidal waveform Bdp1 is selected and supplied to the individual electrodes of the piezoelectric actuator 300. As a result, the ink near the nozzle 21 vibrates slightly in the former half of the print cycle, and the ink is not ejected. The control of the piezoelectric actuator 300 when the dot is not recorded in the pixel is the "second control".

The nozzle 21 has a first portion 21*a* and a second portion 21*b* located downstream of the first portion 21*a* in the ejection direction Z (refer to the lower central part in FIG. 3). Hereinafter, the first portion 21*a* may be referred to as an "upstream first portion 21*a*" and the second portion 21*b* may be referred to as a "downstream second portion 21*b*" to facilitate understanding of the technique. The downstream second portion 21*b* includes an opening end of the nozzle 21 from which the ink droplet is ejected. A meniscus Mn, which is an interface between the ink and the outside air in the nozzle 21, exists inside the downstream second portion 21*b* when the piezoelectric actuator 300 does not generate energy and thus the energy is not applied to the ink in the nozzle 21.

When the piezoelectric actuator 300 generates the energy by the second control described above and the energy is applied to the ink in the nozzle 21, the meniscus Mn vibrates. In the second control, the control unit 121 drives the piezoelectric actuator 300 such that the meniscus Mn of the ink in the nozzle 21 reaches a first position Pz1 in the first portion 21*a*. As a result, it is possible to accelerate the flow of the liquid in the nozzle 21. The vibration of the meniscus Mn under the second control will be further described below.

The voltage generation circuit 124 generates the holding signal having a constant voltage VBS and outputs the voltage to the liquid ejection head 1 (refer to the lower left part in FIG. 4). The holding signal constantly holds potentials of common electrodes (refer to the right side of the piezoelectric actuator 300 in FIG. 4 and the first electrode 60 in FIG. 3) of the plurality of piezoelectric actuators 300 on an actuator substrate 1A.

The liquid ejection head 1 has the actuator substrate 1A and a drive IC 1D (refer to the right part in FIG. 4). The actuator substrate 1A and the drive IC 1D are conceptual divisions in an electrical configuration, and the names do not mean that the configurations are necessarily formed by one substrate or one IC.

The drive IC 1D supplies a drive signal to the individual electrodes of each piezoelectric actuator 300 of the actuator substrate 1A (refer to the left side of the piezoelectric actuator 300 in FIG. 4 and the second electrode 80 in FIG. 3). The drive IC 1D relays the holding signal received from the voltage generation circuit 124 of the control unit 121 to the common electrode of each piezoelectric actuator 300 of the actuator substrate 1A (refer to the right side of the piezoelectric actuator 300 in FIG. 4 and the first electrode 60 in FIG. 3).

The drive IC 1D has a selection controller 1D1 and a selection section 1D2 corresponding to the piezoelectric actuator 300 in a one-to-one correspondence (refer to the right part in FIG. 4). The selection controller 1D1 controls the selection in each selection section 1D2. More specifically, the selection controller 1D1 accumulates the print data supplied from the controller 122 in synchronization with the clock signal for the number of the piezoelectric actuators 300 of the liquid ejection head 1. The selection controller 1D1 instructs each selection section 1D2 to select the drive signals COM-A and COM-B according to the print data at the start timing of the former half and the latter half of the print cycle defined by the timing signal.

Each selection section 1D2 selects any one of the drive signals COM-A and COM-B according to the instruction from the selection controller 1D1 or does not select any one of the drive signals COM-A and COM-B and applies a drive signal of a voltage Vout to the individual electrodes of the corresponding piezoelectric actuator 300 (refer to the left side of the piezoelectric actuator 300 in FIG. 4). The drive signal of the voltage Vout is specifically applied to the second electrode 80 of the piezoelectric actuator 300 (refer to FIG. 3).

The actuator substrate 1A has the plurality of piezoelectric actuators 300. The second electrode 80 on one side of each piezoelectric actuator 300 is provided individually while the first electrode 60 on the other side is provided as the common electrode for the plurality of piezoelectric actuators 300. Different voltages Vout are applied to the individual second electrodes 80 of the plurality of piezoelectric actuators 300 according to the size of the dots to be formed by the drive signal (refer to the left side of the piezoelectric actuators 300 in FIG. 4). A constant voltage VBS is applied to the common first electrode 60 of the plurality of piezoelectric actuators 300 by the holding signal through a wiring pattern 1L (refer to the right side of the piezoelectric actuators 300 in FIG. 4).

3. Control of Piezoelectric Actuator 300 according to Ink Type:

In the second control, the control unit 121 performs different control depending on an ink type. When a first type of ink is supplied to the nozzle 21, the control unit 121 applies a first electric signal to the piezoelectric actuator 300 through the drive IC 1D (refer to FIG. 4). When the nozzle 21 is supplied with a second type of ink having a higher viscosity than the first type of ink, the control unit 121 applies a second electric signal different from the first electric signal to the piezoelectric actuator 300 through the drive IC 1D. Waveform data of the electric signal associated with the ink type is stored in a ROM of the control unit 121. In FIG. 4, all of the electric signals are represented by the drive signals of the voltage Vout, more specifically, the trapezoidal waveform Bdp1 of the drive signal COM-B.

When the second electric signal is applied to the piezoelectric actuator 300, an amount of energy generated by the piezoelectric actuator 300 and applied to the second type of ink is larger than an amount of energy generated by the piezoelectric actuator 300 and applied to the first type of ink when the first electric signal is applied to the piezoelectric actuator 300. With such a process, the second type of ink can effectively flow in the nozzle 21 even when the second type of ink having the higher viscosity than the first type of ink is supplied.

4. Control of Piezoelectric Actuator 300 according to Passage of Time:

The control unit 121 performs control according to the passage of time in the second control. When a cumulative value of a drive time of the piezoelectric actuator 300 after the use of the liquid ejection apparatus 100 is first started is a first time, the control unit 121 applies a third electric signal to the piezoelectric actuator 300 through the drive IC 1D. When the cumulative value of the drive time of the piezoelectric actuator 300 is a second time which is longer than the first time, the control unit 121 applies a fourth electric signal to the piezoelectric actuator 300 through the drive IC 1D.

An amount of energy generated by the piezoelectric actuator 300 when the fourth electric signal is applied to the piezoelectric actuator 300 is larger than an amount of energy generated by the piezoelectric actuator 300 when the third electric signal is applied to the piezoelectric actuator 300.

Predetermined time intervals for the cumulative value of the drive time of the piezoelectric actuator 300 and coefficients associated with the time intervals are stored in the ROM of the control unit 121. The coefficient associated with the time interval becomes larger as the coefficient is associated with the later time interval. The waveform of the electric signal applied to the piezoelectric actuator 300 is generated by multiplying the reference trapezoidal waveform Bdp1 by the coefficient.

The cumulative value of the drive time of the piezoelectric actuator 300 can be measured by a timer included in the control unit 121. The cumulative value of the drive time of the piezoelectric actuator 300 can be obtained in a pseudo manner from a cumulative value of the number of times of driving the piezoelectric actuator 300 counted by the control unit 121. In FIG. 4, all of the electric signals are represented by drive signals of the voltage Vout.

With the passage of time, the piezoelectric layer 70 may deteriorate and an amount of deformation with respect to the applied energy may decrease. With the passage of time, a solvent of the ink may be volatilized, a component thereof may be oxidized. Therefore, the ink may be less likely to flow. However, the above process is performed to enable the ink that is less likely to flow with the passage of time to flow effectively in the nozzle 21.

Figure 5:
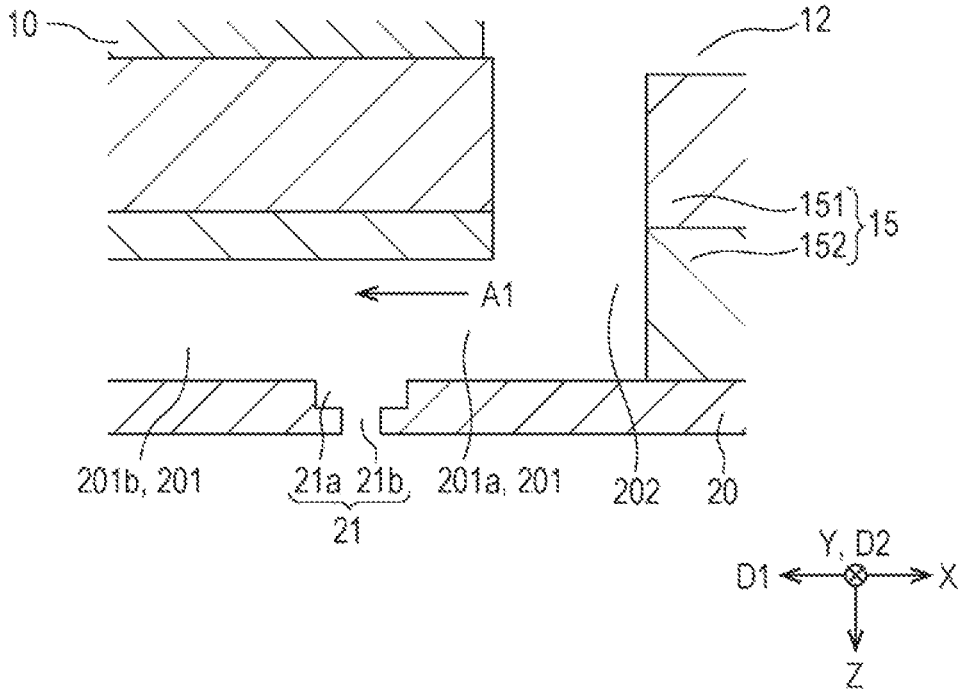
FIG. 5 is an enlarged view of a portion near a nozzle 21 in FIG. 3.

A2. Nozzle Configuration:

FIG. 5 is an enlarged view of a portion near the nozzle 21 of FIG. 3. The nozzle 21 communicates with the first flow path 201. That is, the nozzle 21 is provided so as to branch off from the first flow path 201. A flow path portion that is located upstream of a portion of the first flow path 201 where the nozzle 21 is coupled to the first flow path 201 and supplies the ink to the nozzle 21 is referred to as a supply flow path portion 201*a*. A flow path portion that is located downstream of the portion of the first flow path 201 where the nozzle 21 is coupled to the first flow path 201 and discharges the ink from the nozzle 21 is referred to as a discharge flow path portion 201*b*.

The ink in the liquid ejection head 1 is applied with energy for the ejection from the piezoelectric actuator 300 in the pressure chamber 12 (refer to the upper right part of FIG. 5). The first flow path 201 allows the ink to which the kinetic energy is applied to flow in a negative X direction (refer to the arrow A1). The negative X direction in which the ink flows is referred to as a "first direction D1". The Y direction is referred to as a "second direction D2". The nozzle 21 ejects the ink in the positive Z direction by the energy applied by the piezoelectric actuator 300. The positive Z direction is also referred to as an "ejection direction Z".

The nozzle 21 has the first portion 21*a* and the second portion 21*b* along the Z direction. The second portion 21*b* is located downstream of the first portion 21*a* in the ejection direction Z. A shape of the first portion 21*a* in a cross section perpendicular to the ejection direction Z is constant regardless of a position in the ejection direction Z. A shape of the second portion 21*b* in the cross section perpendicular to the ejection direction Z is constant regardless of the position in the ejection direction Z.

As a result, a width of the nozzle 21 in the first direction D1 is constant regardless of the position in the ejection direction Z, in the first portion 21*a*. In the first portion 21*a*, a width of the nozzle 21 in the second direction D2 is constant regardless of the position in the ejection direction Z. In the second portion 21*b*, a width of the nozzle 21 in the first direction D1 is constant regardless of the position in the ejection direction Z. In the second portion 21*b*, a width of the nozzle 21 in the second direction D2 is constant regardless of the position in the ejection direction Z. A cross-sectional area of the second portion 21*b* in the cross section perpendicular to the ejection direction Z is smaller than a cross-sectional area of the first portion 21*a* in the cross section perpendicular to the ejection direction Z.

Figure 6:
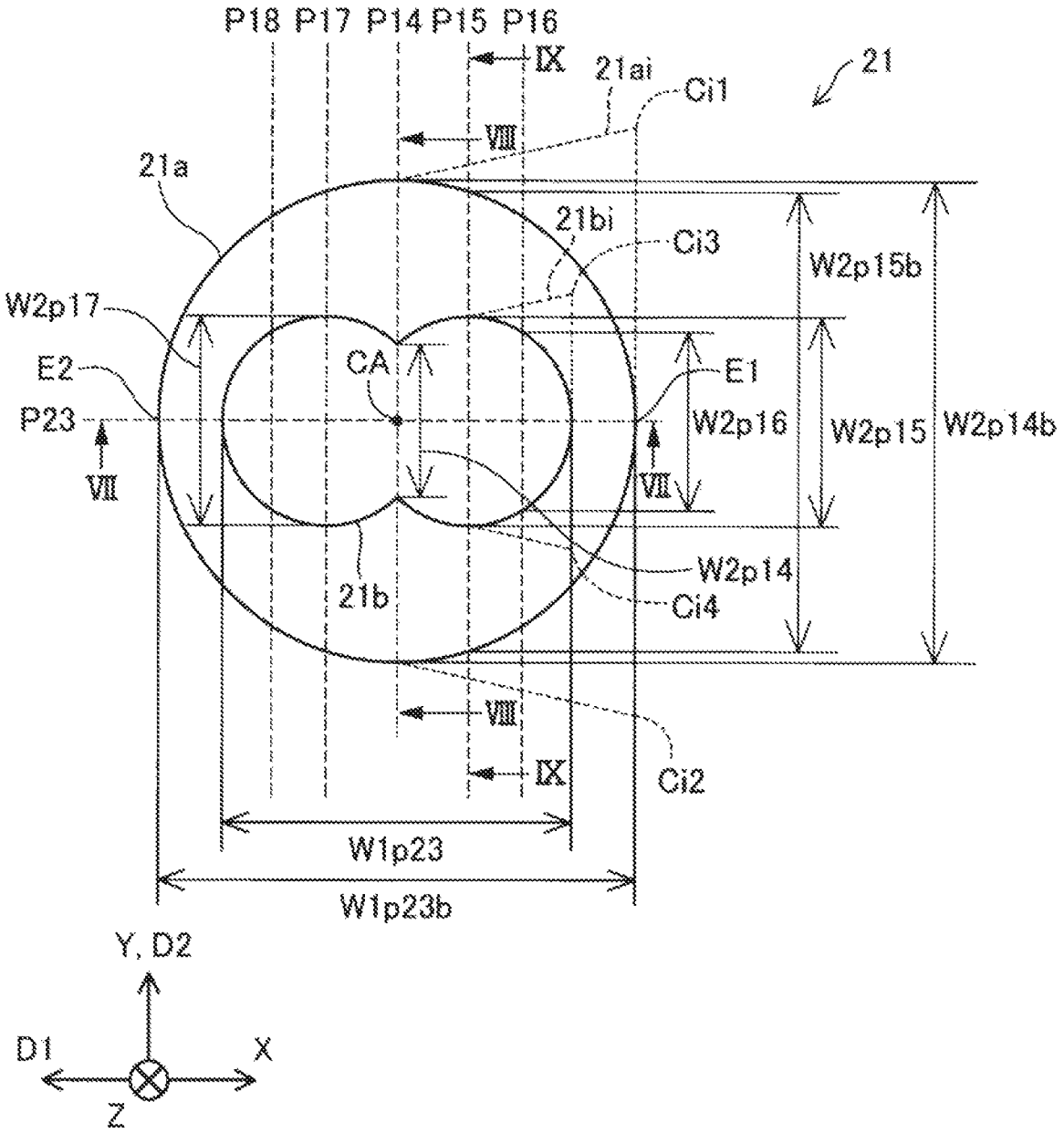
FIG. 6 is a plan view schematically showing a relationship between a first portion 21*a* and a second portion 21*b* of the nozzle 21 when the nozzle 21 is viewed along a Z direction.
Figure 7:
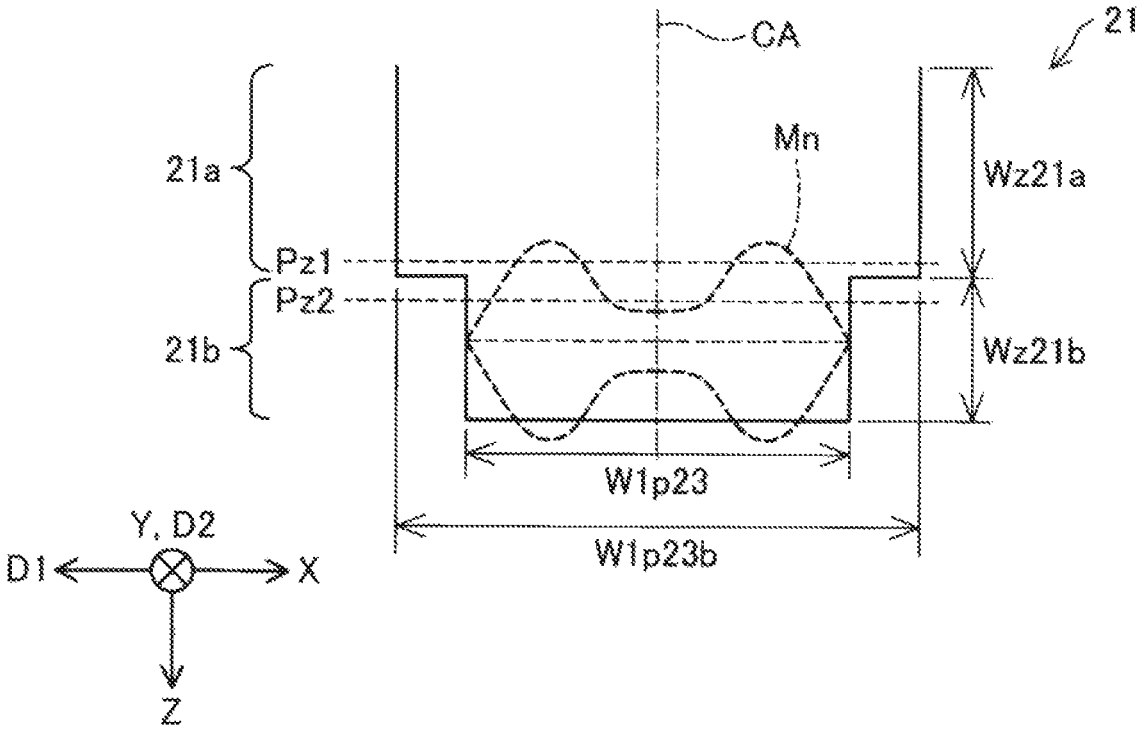
FIG. 7 is a cross-sectional view taken along a line VII-VII in FIG. 6.
Figure 8:
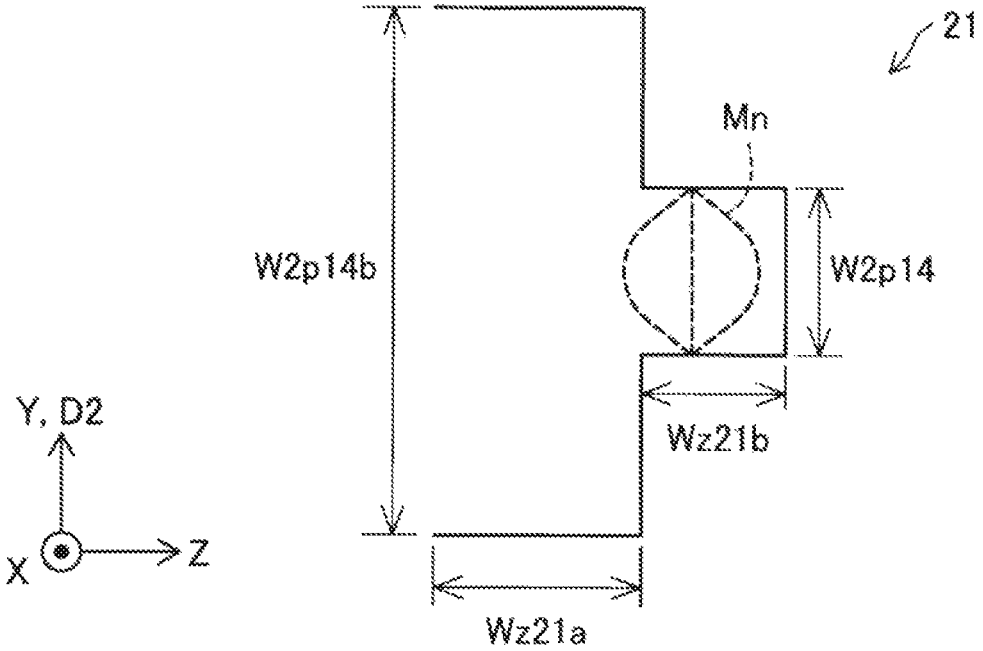
FIG. 8 is a cross-sectional view taken along a line VIII-VIII in FIG. 6.
Figure 9:
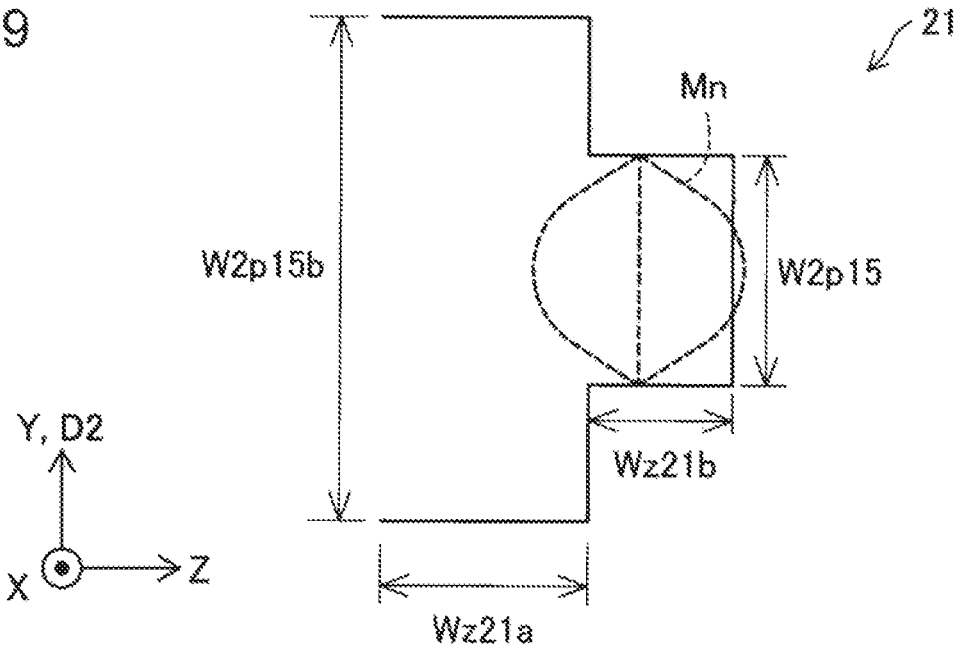
FIG. 9 is a cross-sectional view taken along a line IX-IX in FIG. 6.

FIG. 6 is a plan view schematically showing a relationship between the first portion 21*a* and the second portion 21*b* of the nozzle 21 when the nozzle 21 is viewed along the Z direction. FIG. 7 is a cross-sectional view taken along a line VII-VII in FIG. 6. FIG. 8 is a cross-sectional view taken along a line VIII-VIII in FIG. 6. FIG. 9 is a cross-sectional view taken along a line IX-IX in FIG. 6. FIGS. 6 to 9 are the views for describing the shape of the nozzle 21 and do not accurately reflect dimensions of each part of the nozzle 21.

A specific position in the ejection direction Z in a space in the nozzle 21 is referred to as the "first position Pz1" (refer to FIG. 7). The first position Pz1 is a position included in the first portion 21*a* of the nozzle 21. More specifically, the first position Pz1 is a position that is 1/10 of the dimension of the first portion 21*a* in the Z direction from a boundary between the first portion 21*a* and the second portion 21*b* of the nozzle 21. The first position Pz1 specifies the position in the ejection direction Z and does not limit the positions in the X and Y directions.

A specific position downstream of the first position Pz1 in the ejection direction Z in the space in the nozzle 21 is referred to as a "second position Pz2". The second position Pz2 is a position included in the second portion 21*b* of the nozzle 21. More specifically, the second position Pz2 is a position that is 1/5 of the dimension of the second portion 21*b* in the Z direction from the boundary between the first portion 21*a* and the second portion 21*b* of the nozzle 21. The second position Pz2 specifies the position in the ejection direction Z and does not limit the positions in the X and Y directions.

The second direction D2, that is, the center in the Y direction in the space in the nozzle 21 is referred to as a "third position P23" (refer to FIG. 6). The third position P23 specifies the position in the second direction D2 and does not limit the positions in the Z and X directions.

A specific position in the space in the nozzle 21 in the first direction D1, that is, the negative X direction is referred to as a "fourth position P14" (refer to FIG. 6). More specifically, the fourth position P14 is a central position in the space in the nozzle 21 in the first direction D1. The fourth position P14 specifies the position in the first direction D1 and does not limit the positions in the Y and Z directions.

A specific position in the space in the nozzle 21 that is closer to one end E1 of the nozzle 21 in the first direction D1 than is the fourth position P14 is referred to as a "fifth position P15" (refer to FIG. 6). A specific position in the space in the nozzle 21 that is closer to the one end E1 of the nozzle 21 in the first direction D1 than is the fifth position P15 is referred to as a "sixth position P16". The fifth position P15 and the sixth position P16 specify the position in the first direction D1 and do not limit the positions in the Y and Z directions.

A specific position in the space in the nozzle 21 that is closer to the other end E2 of the nozzle 21 in the first direction D1 than is the fourth position P14 is referred to as a "seventh position P17" (refer to FIG. 6). The seventh position P17 is a position symmetrical to the fifth position P15 with respect to the fourth position P14. A specific position in the space in the nozzle 21 that is closer to the other end E2 of the nozzle 21 in the first direction D1 than is the seventh position P17 is referred to as an "eighth position P18". The eighth position P18 is a position symmetrical to the sixth position P16 with respect to the fourth position P14. The seventh position P17 and the eighth position P18 specify the position in the first direction D1 and do not limit the positions in the Y and Z directions.

At a position where the position in the ejection direction Z is the first position Pz1 in the upstream first portion 21*a* and the position in the second direction D2 is the central third position P23, the width of the nozzle 21 in the first direction D1 is a "first width W1*p*23*b*" (refer to the lower part in FIG. 7). At a position where the position in the ejection direction Z is the second position Pz2 in the downstream second portion 21*b* and the position in the second direction D2 is the central third position P23, the width of the nozzle 21 in the first direction D1 is a "second width W1*p*23".

At a position where the position in the ejection direction Z is the second position Pz2 in the downstream second portion 21*b* and the position in the first direction D1 is the fourth position P14, the width of the nozzle 21 in the second direction D2 is a "third width W2*p*14" (refer to the center part in FIG. 6 and the right part in FIG. 8). At a position where the position in the ejection direction Z is the second position Pz2 in the downstream second portion 21*b* and the position in the first direction D1 is the fifth position P15, the width of the nozzle 21 in the second direction D2 is a "fourth width W2p15" (refer to the right part in FIG. 6 and the right part in FIG. 9).

At a position where the position in the ejection direction Z is the second position Pz2 in the downstream second portion 21b and the position in the first direction D1 is the sixth position P16, the width of the nozzle 21 in the second direction D2 is a "fifth width W2p16" (refer to the right part in FIG. 6). At a position where the position in the ejection direction Z is the second position Pz2 in the downstream second portion 21b and the position in the first direction D1 is the seventh position P17, the width of the nozzle 21 in the second direction D2 is a "sixth width W2p17" (refer to the left part in FIG. 6).

At a position where the position in the ejection direction Z is the first position Pz1 in the upstream first portion 21a and the position in the first direction D1 is the fourth position P14, the width of the nozzle 21 in the second direction D2 is a "seventh width W2p14b" (refer to the right part in FIG. 6 and the left part in FIG. 8). At a position where the position in the ejection direction Z is the first position Pz1 in the upstream first portion 21a and the position in the first direction D1 is the fifth position P15, the width of the nozzle 21 in the second direction D2 is an "eighth width W2p15b" (refer to the right part in FIG. 6 and the left part in FIG. 9).

A width of the first portion 21a upstream of the nozzle 21 in the ejection direction Z is a "ninth width Wz21a" (refer to FIGS. 7 to 9). A width of the downstream second portion 21b in the ejection direction Z is a "tenth width Wz21b".

The tenth width Wz21b of the downstream second portion 21b is smaller than the ninth width Wz21a of the upstream first portion 21a (refer to FIGS. 7 to 9). The meniscus Mn, which is the interface between the ink and the outside air in the nozzle 21, has a recessed shape slightly recessed toward the inside of the nozzle 21 in the second portion 21b when the energy is not applied to the ink in the nozzle 21. With the above configuration, a position of the meniscus Mn that vibrates when the energy is applied to the ink in the nozzle 21 can reach the upstream first portion 21a (refer to FIGS. 7 and 9). Therefore, it is possible to accelerate the flow of the ink in the nozzle 21. The ninth width Wz21a of the upstream first portion 21a having a larger cross-sectional area in the ejection direction Z is larger than the tenth width Wz21b of the downstream second portion 21b (refer to FIGS. 7 to 9). Therefore, it is possible to ensure the amount of ink in the nozzle 21 and deliver a sufficient amount of ink from the opening end of the second portion 21b by one operation of the piezoelectric actuator 300.

In the nozzle 21, an outer shape of the first portion 21a located upstream of the second portion 21b is circular (refer to FIG. 6). As a result, the seventh width W2p14b in the second direction D2 and the first width W1p23b in the first direction D1 are equal to each other. The width of the nozzle 21 in the second direction D2 becomes smaller as the position in the first direction D1 goes from the fourth position P14 to the fifth position P15. The eighth width W2p15b in the second direction D2 at the fifth position P15 is smaller than the seventh width W2p14b at the center of the fourth position P14 (refer to the right part in FIG. 6).

With such a configuration, it is possible to introduce the ink into the nozzle 21, with a stable flow having less change in the distribution of a flow velocity in a plane extending in the first direction D1 and the second direction D2, at the first position Pz1 upstream in the ejection direction Z as compared with an aspect in which the seventh width W2p14b in the second direction D2 and the first width W1p23b in the first direction D1 are significantly different from each other.

With such a configuration, the following effects are obtained as compared with an aspect in which the width in the second direction D2 increases (refer to the virtual first portion 21ai in FIG. 6) or the width in the second direction D2 increases and decreases as a position approaches from the fourth position P14 to the fifth position P15 along the first direction D1 at the first position Pz1 upstream in the ejection direction Z. That is, angles of corner portions Ci1 and Ci2 at both ends in the second direction D2 at an end in the first direction D1 can be increased, or the corner portions Ci1 and Ci2 at the ends in the second direction D2 can be eliminated. As a result, it is possible to reduce the possibility of ink retention at the corner portions Ci1 and Ci2 at both ends in the second direction D2. In the present embodiment, since the outer shape of the first portion 21a is the circle, there is no corner portion at the ends in the second direction D2 (refer to FIG. 6).

An outer shape of the second portion 21b located downstream of the first portion 21a in the nozzle 21 is equal to an outer shape formed when two circles having the same diameter are respectively disposed at positions where a distance between the centers of the circles is smaller than the diameter of the circle. As a result, at the second position Pz2 included in the downstream second portion 21b, the second width W1p23 in the first direction D1 is larger than the third width W2p14 and the fourth width W2p15 in the second direction D2 (refer to FIG. 6). That is, at the second position Pz2 downstream in the ejection direction Z, the nozzle 21 has a flat shape in the second direction D2 and a long shape in the first direction D1.

With such a configuration, the ink in the nozzle 21 is easily stirred by the flow of the ink in the first flow path 201 as compared with an aspect in which the second width W1p23 in the first direction D1 is smaller than the third width W2p14 and the fourth width W2p15 in the second direction D2. As a result, the ink is less likely to retain in each part of the nozzle 21. In particular, it is possible to effectively suppress the liquid retention near an inner wall located upstream of the first flow path 201 with respect to a central axis of the nozzle 21 and near an inner wall located downstream of the first flow path 201 with respect to a central axis CA of the nozzle 21, out of an inner wall of the nozzle 21.

The outer shape of the downstream second portion 21b is included in the outer shape of the first portion 21a which is a perfect circle (refer to FIG. 6). As a result, at a position where the position in the second direction D2 is the third position P23 which is the center of the nozzle 21, the second width W1p23 in the first direction D1 at the second position Pz2 included in the downstream second portion 21b is smaller than the first width W1p23b in the first direction D1 at the first position Pz1 included in the upstream first portion 21a (refer to the lower part in FIG. 6). More specifically, the second width W1p23 is 80% of the first width W1p23b.

The second width W1p23 of the downstream second portion 21b is made larger than ¾ times and smaller than 9/10 times the first width W1p23b of the upstream first portion 21a to obtain the following effects. That is, a larger amount of ink can be ejected from the nozzle 21 by one operation of the piezoelectric actuator 300 than when the second width W1p23 is smaller than ¾ times. It is possible to more stably eject the ink from the nozzle 21 in a constant direction than when the second width W1p23 is larger than 9/10 times.

At a position where the position in the first direction D1 is the fourth position P14 which is the center of the nozzle 21, the seventh width W2p14b in the second direction D2 at the first position Pz1 included in the upstream first portion 21*a* is larger than the third width W2*p*14 in the second direction D2 at the second position Pz2 included in the downstream second portion 21*b* (refer to the central part in FIG. 6 and FIG. 8). At a position where the position in the first direction D1 is the fifth position P15, the eighth width W2*p*15*b* in the second direction D2 at the first position Pz1 included in the upstream first portion 21*a* is larger than the fourth width W2*p*15 in the second direction D2 at the second position Pz2 included in the downstream second portion 21*b* (refer to FIGS. 6 and 9).

With such a configuration, the following effects are obtained as compared with an aspect in which the upstream seventh width W2*p*14*b* is smaller than the downstream third width W2*p*14 and the upstream eighth width W2*p*15*b* is smaller than the downstream fourth width W2*p*15. That is, it is possible to efficiently supply the ink to the nozzle 21 from the upstream first flow path 201 toward the opening end of the nozzle 21. It is possible to stably eject the ink from the nozzle 21 in a constant direction.

The fifth position P15 in the first direction D1 is a position where the center of one circle is disposed. The seventh position P17 in the first direction D1 is a position where the center of the other circle is disposed. As a result, in the downstream second portion 21*b*, the fourth width W2*p*15 in the second direction D2 at the fifth position P15 is larger than the third width W2*p*14 in the second direction D2 at the fourth position P14 (refer to FIG. 6).

When the kinetic energy is applied to the ink in the nozzle 21 by the piezoelectric actuator 300, the meniscus Mn, which is the interface between the ink in the nozzle 21 and the outside air, vibrates most at a portion farthest from the inner wall in the nozzle 21 (refer to FIGS. 8 and 9). On the other hand, a portion of the nozzle 21 near the inner wall is less likely to vibrate. Note that a difference between a vibration width of the portion near the inner wall in the nozzle 21 and a vibration width of the portion farthest from the inner wall in the nozzle 21 becomes smaller as a distance between the portion farthest from the inner wall in the nozzle 21 and the inner wall in the nozzle 21 is smaller.

In the present embodiment, at the third position P23 where the position in the second direction D2 is the center, the second width W1*p*23 at the second position Pz2 in the ejection direction Z is smaller than the first width W1*p*23*b* at the more upstream first position Pz1 (refer to the lower part in FIG. 6 and the lower part in FIG. 7). Therefore, the following effects are obtained as compared with an aspect in which the second width W1*p*23 is larger than the first width W1*p*23*b*. That is, it is possible to efficiently supply the ink to the nozzle 21 from the upstream first flow path 201 toward the opening end of the nozzle 21 and stably eject the ink from the nozzle 21 in a constant direction.

In the present embodiment, at the second position Pz2 included in the downstream second portion 21*b*, the fourth width W2*p*15 at the position where the position in the first direction D1 is the fifth position P15 is larger than the third width W2*p*14 at a position where the position in the first direction D1 is the fourth position P14 farther from the end E1 (refer to the central part in FIG. 6). Therefore, the following effects are obtained as compared with an aspect in which the fourth width W2*p*15 is less than the third width W2*p*14, for example, an aspect in which the outer shape of the second portion 21*b* is circular. That is, it is possible to reduce the distance between the portion farthest from the inner wall of the second portion 21*b* and the inner wall of the second portion 21*b* at the second position Pz2 included in the downstream second portion 21*b*.

In the present embodiment, the portion farthest from the inner wall of the second portion 21*b* is near the center of each of the two circles forming the second portion 21*b*. Therefore, the distance between the portion of the second portion 21*b* farthest from the inner wall and the inner wall of the second portion 21*b* is substantially equal to a radius of the two circles. On the other hand, the distance between the portion of the second portion farthest from the inner wall and the inner wall of the second portion is equal to a radius of one circle forming the second portion in an aspect in which the outer shape of the second portion is configured of one circle having an area equal to an area of the second portion 21*b*. The radius of the one circle is larger than the radius of the two circles of the second portion 21*b*.

In the present embodiment, as a result of the distance between the portion farthest from the inner wall in the nozzle 21 and the inner wall becoming smaller, the difference between the vibration width of the portion of the meniscus Mn near the inner wall in the nozzle 21 and the vibration width of the portion farthest from the inner wall in the nozzle 21 becomes smaller. Therefore, the energy is applied to the ink in the nozzle 21 to enable also the ink near the inner wall in the nozzle 21 to flow efficiently, in addition to the ink at the portion farthest from the inner wall in the nozzle 21. As a result, it is possible to reduce the amount of ink retained in the nozzle 21.

It can also be described that such an effect is greater as an outer peripheral distance in the cross section of the nozzle is larger when a cross-sectional area of the nozzle perpendicular to the ejection direction Z is assumed to be constant, as compared with an aspect in which the nozzle has a circular cross section.

In the present embodiment, at the second position Pz2 included in the downstream second portion 21*b*, the third width W2*p*14 of the nozzle 21 in the second direction D2 at the fourth position P14 in the first direction D1 is 60% of the fourth width W2*p*15 of the nozzle 21 in the second direction D2 at the fifth position P15 in the first direction D1 (refer to the central part in FIG. 6).

The third width W2*p*14 is larger than ⅙ times and smaller than ⅔ times the fourth width W2*p*15 to obtain the following effects. That is, it is possible to eject the ink from the nozzle 21, with the stable flow having less change in the distribution of the flow velocity in the plane stretched in the first direction D1 and the second direction D2, as compared with an aspect in which the third width W2*p*14 is smaller than ⅙ times the fourth width W2*p*15. The energy is applied to the ink in the nozzle 21 to enable the ink near the inner wall in the nozzle 21 to flow more efficiently as compared with an aspect in which the third width W2*p*14 is larger than ⅔ times the fourth width W2*p*15. As a result, it is possible to reduce the amount of ink retained in the nozzle 21.

In the present embodiment, at the second position Pz2 included in the downstream second portion 21*b*, (i) the width of the nozzle 21 in the second direction D2 becomes larger as the position in the first direction D1 goes from the fourth position P14 to the fifth position P15 (refer to the right part in FIG. 6). (ii) The width of the nozzle 21 in the second direction D2 becomes smaller as the position in the first direction D1 goes from the fifth position P15 to the sixth position P16. As a result, the fifth width W2*p*16 of the sixth position P16 is smaller than the fourth width W2*p*15 of the fifth position P15.

With such a configuration, the following effects are obtained as compared with an aspect in which the width in the second direction D2 increases (refer to the virtual second portion 21*bi* in FIG. 6) or the width in the second direction D2 increases and decreases as a position approaches the end along the first direction D1 at the second position Pz2 included in the downstream second portion 21*b*. That is, angles of corner portions Ci3 and Ci4 at both ends in the second direction D2 at the end in the first direction D1 can be increased, or the corner portions Ci3 and Ci4 at the ends in the second direction D2 can be eliminated. As a result, it is possible to reduce the possibility of the ink retention at the corner portions Ci3 and Ci4 at both ends in the second direction D2. In the present embodiment, since an outer shape of the second portion 21*b* from the fourth position P14 to the one end E1 side is a circular arc, there is no corner portion at the ends in the second direction D2 (refer to FIG. 6).

At the position where the position in the first direction D1 is the fourth position P14 which is the center of the nozzle 21, the width of the downstream second portion 21*b* in the second direction D2 is not maximum whereas the width of the upstream first portion 21*a* in the second direction D2 is maximum (refer to the central part in FIG. 6). At the position where the position in the first direction D1 is the fifth position P15, the width of the downstream second portion 21*b* in the second direction D2 is maximum whereas the width of the upstream first portion 21*a* in the second direction D2 is not maximum. Therefore, a difference between the seventh width W2*p*14*b* and the third width W2*p*14 is larger than a difference between the eighth width W2*p*15*b* and the fourth width W2*p*15.

An axis of symmetry of the second portion 21*b* coincides with the fourth position P14. That is, the axis of symmetry of the second portion 21*b* is the center of the nozzle 21 in the first direction D1. With such a configuration, the following effects are obtained as compared with an aspect in which the fourth position P14 in which the width of the nozzle 21 in the second direction D2 is the narrowest greatly deviates from the center in the nozzle 21 in the first direction D1. That is, it is possible to introduce the ink into the nozzle 21 with the stable flow having less change in the distribution of the flow velocity in the plane stretched in the first direction D1 and the second direction D2.

In the present embodiment, the second portion 21*b* has a line-symmetrical shape with a symmetric axis that is parallel to the second direction D2 and that passes through the center of the circle of the first portion 21*a*. As a result, for example, the sixth width W2*p*17 in the second direction D2 at the seventh position P17 is larger than the third width W2*p*14 in the second direction D2 at the fourth position P14 which is the center. The width in the second direction D2 at the eighth position P18 is smaller than the sixth width W2*p*17 in the second direction D2 at the seventh position P17. With such a configuration, the above effects are obtained on both sides of the symmetric axis.

The first flow path 201 in the embodiment is also referred to as a "flow path". The piezoelectric actuator 300 is also called an "energy generation element". The control unit 121 is also referred to as a "drive controller".

B. Second Embodiment:

In a liquid ejection apparatus according to a second embodiment, a shape of a nozzle 21*s* is different from the shape of the nozzle 21 of the liquid ejection apparatus 100 according to the first embodiment. Other points of the liquid ejection apparatus according to the second embodiment are the same as those of the liquid ejection apparatus 100 according to the first embodiment.

Figure 10:
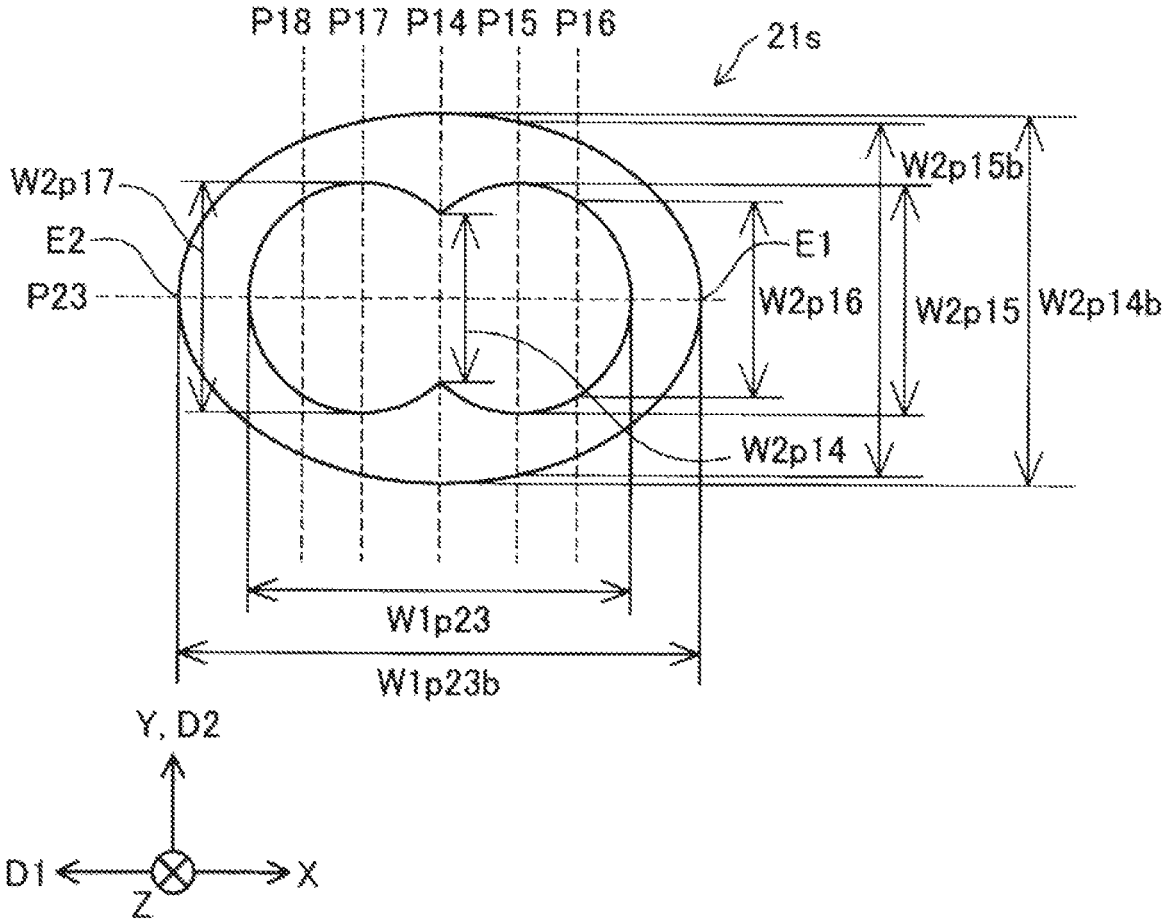
FIG. 10 is a plan view schematically showing a relationship between a first portion 21*a* and a second portion 21*b* of a nozzle 21*s* when the nozzle 21*s* is viewed along the Z direction.

FIG. 10 is a plan view schematically showing a relationship between a first portion 21*a* and a second portion 21*b* of the nozzle 21*s* when the nozzle 21*s* is viewed along the Z direction. A name of each part of the nozzle 21*s* is the same as the name of each part of the nozzle 21.

An outer shape of the first portion 21*a* located upstream of the second portion 21*b* in the nozzle 21*s* is elliptical. As a result, the seventh width W2*p*14*b* of the first portion 21*a* in the second direction D2 at the fourth position P14, which is the center in the first direction D1, is smaller than the first width W1*p*23*b* of the first portion 21*a* in the first direction D1 at the third position P23, which is the center in the second direction D2. That is, at the first position Pz1 of the first portion 21*a* located upstream in the ejection direction Z, the nozzle 21 has a flat shape in the second direction D2 and a long shape in the first direction D1 in which the ink flows in the first flow path 201.

With such a configuration, the ink in the nozzle 21 is easily stirred by the flow of the ink along the first direction D1 in the first flow path 201 as compared with an aspect in which the seventh width W2*p*14*b* is larger than the first width W1*p*23*b*. As a result, the ink is less likely to retain in the nozzle 21.

C. Another Embodiment:

C1. Another Aspect 1:

(1) In the above embodiment, the ink is applied with the kinetic energy for ejection generated by the piezoelectric actuator 300 (refer to FIG. 3). However, an element that ejects the liquid from the nozzle by gas generated by vaporization of the liquid which is heated to boil may be used as the energy generation element that generates the energy for ejecting the liquid and applies the energy to the liquid.

(2) In the above embodiment, the nozzle 21 has the first portion 21*a* and the second portion 21*b* located downstream of the first portion 21*a* in the ejection direction Z (refer to the lower central part in FIG. 5). The first position Pz1 is a position included in the first portion 21*a* of the nozzle 21 (refer to FIG. 7). The second position Pz2 is a position included in the second portion 21*b* of the nozzle 21. However, the first position and the second position may also be determined in an aspect other than an aspect in which the nozzles are composed of the constituent portions respectively having a constant shape along the ejection direction. The second position is a specific position in the nozzle, which is downstream of the first position in the ejection direction. The cross-sectional area of the cross section of the nozzle at the second position perpendicular to the ejection direction is preferably smaller than the cross-sectional area of the cross section of the nozzle at the first position perpendicular to the ejection direction.

(3) In the above embodiment, the third position P23 is the center in the space in the nozzle 21 in the second direction D2, that is, the Y direction (refer to the left part in FIG. 6). However, the third position P23 may be a position deviated from the center in the space in the nozzle 21 in the second direction D2, that is, the Y direction. The third position P23 only needs to be in a substantially center in the space in the nozzle 21 in the second direction D2, that is, the Y direction. The "substantially center" in the nozzle in a certain direction means a range of ±10% of a maximum width dimension of the space in the nozzle along the direction from the center in the certain direction in the space in the nozzle.

(4) In the above embodiment, the fourth position P14 is the center position in the space in the nozzle 21 in the first direction D1 (refer to FIG. 6). However, the fourth position P14 may be any position in the space in the nozzle 21 in the first direction D1.

(5) In the above embodiment, the fifth position P15 is a specific position in the space in the nozzle 21 that is closer to the one end E1 of the nozzle 21 in the first direction D1 than is the fourth position P14 (refer to FIG. 6). However, the fifth position P15 may be a specific position in the space in the nozzle 21 that is closer to the other end E2 of the nozzle 21 in the first direction D1 than is the fourth position P14.

(6) In the above embodiment, the outer shape of the second portion 21*b* located downstream of the first portion 21*a* in the nozzle 21 is equal to the outer shape formed when the two circles with the same diameter are respectively disposed at the positions where the distance between the centers of the circles is smaller than the diameter of the circle (refer to FIG. 6). However, the outer shape of the second portion of the nozzle in the cross section perpendicular to the ejection direction Z may be another shape. For example, the outer shape of the second portion 21*b* may be a shape obtained by disposing three or more circles to overlap each other. The outer shape of the internal space of the second portion 21*b* may be a substantially circular shape or a substantially elliptical shape, and may be a shape having a portion protruding from an inner surface of the circle or the ellipse toward the center.

(7) In the first embodiment, the outer shape of the upstream first portion 21*a* in the cross section perpendicular to the ejection direction Z is circular (refer to FIG. 6). However, the outer shape of the first portion may be various shapes such as an elliptical shape (refer to FIG. 10), an oval shape, and a polygonal shape, in addition to the circular shape.

(8) In the above embodiment, the first position Pz1 is a position that is 1/10 of the dimension of the first portion 21*a* in the Z direction from the boundary between the first portion 21*a* and the second portion 21*b* of the nozzle (refer to FIG. 7). However, a distance between the first position Pz1 and the boundary between the first portion 21*a* and the second portion 21*b* of the nozzle 21 may also be another value such as 1/5, 1/4, 1/3, 1/2, 2/3, or 3/4 of the dimension of the first portion 21*a* in the Z direction.

(9) In the above embodiment, the second position Pz2 is a position that is 1/5 of the dimension of the second portion 21*b* in the Z direction from the boundary between the first portion 21*a* and the second portion 21*b* of the nozzle (refer to FIG. 7). However, the distance between the second position Pz2 and the boundary between the first portion 21*a* and the second portion 21*b* of the nozzle 21 may also be another value such as 1/4, 1/3, 1/2, 2/3, or 3/4 of the dimension of the second portion 21*b* in the Z direction.

(10) In the above embodiment, the waveform data of the electric signal associated with the ink type is stored in the ROM of the control unit 121 to perform the second control according to the ink type. The predetermined time intervals for the cumulative value of the drive time of the piezoelectric actuator 300 and the coefficients associated with the time intervals are stored in the ROM of the control unit 121 to perform the second control according to the passage of time.

However, for example, an aspect may be used in which the predetermined time intervals for the cumulative value of the drive time of the piezoelectric actuator 300 and the waveform data of the electric signal associated with the time intervals are stored in the ROM of the control unit 121. An aspect may be used in which the coefficient associated with the ink type is stored in the ROM of the control unit 121 and the trapezoidal waveform Bdp1 which is a reference is multiplied by the coefficient according to the ink type to generate the waveform of the electric signal.

(11) In the above embodiment, the ink circulates between the liquid ejection head 1 and the outside. However, for example, even for a system in which the ink is supplied into the liquid ejection head 1 and then is not discharged from other than the nozzle, that is, a non-circulating system, the retention can be eliminated by employing the same nozzle configuration as that of the above embodiment in an aspect in which there are portions having different cross-sectional areas in the flow path portion in the nozzle and the liquid is retained at the step. Even in such an aspect, when the flow direction of the ink in the coupling portion in the flow path coupled to the nozzle intersects with the flow direction of the ink in the nozzle, the liquid retention is likely to occur remarkably. Therefore, the effect obtained when the nozzle configuration is the same as that of the above embodiment is increased.

C2. Another Aspect 2:

In the above embodiment, the fifth position P15 in the first direction D1 is a position where the center of one circle forming the outer shape of the second portion 21*b* is disposed (refer to FIG. 6). The fifth width W2*p*16 in the second direction D2 at the sixth position P16 in the first direction D1 is smaller than the fourth width W2*p*15 in the second direction D2 at the fifth position P15 in the first direction D1. However, the fifth position P15 may be another position in the first direction D1. The fifth width W2*p*16 at the sixth position P16 may be equal to or larger than the fourth width W2*p*15 at the fifth position P15 (refer to 21*bi* in FIG. 6).

C3. Another Aspect 3:

In the above embodiment, at the second position Pz2 included in the downstream second portion 21*b*, (i) the width of the nozzle 21 in the second direction D2 becomes larger as the position in the first direction D1 goes from the fourth position P14 to the fifth position P15 (refer to the right part in FIG. 6). (ii) The width of the nozzle 21 in the second direction D2 becomes smaller as the position in the first direction D1 goes from the fifth position P15 to the sixth position P16. However, the cross-sectional shape of the second portion 21*b* in the cross section perpendicular to the ejection direction Z may be another shape. For example, a portion other than the fifth position P15 may have a shape that maximizes the width in the second direction D2 (refer to 21*bi* in FIG. 6). The width in the second direction D2 may change, including a decrease and an increase, in one or both of front and rear of the portion where the width in the second direction D2 is maximized.

C4. Another Aspect 4:

In the above embodiment, the sixth width W2*p*17 in the second direction D2 at the seventh position P17 is larger than the third width W2*p*14 in the second direction D2 at the central fourth position P14 (refer to FIG. 6). However, an aspect may be employed in which the sixth width W2*p*17 is smaller than the third width W2*p*14 in the nozzle.

C5. Another Aspect 5:

In the above embodiment, in the upstream first portion 21*a*, the eighth width W2*p*15*b* in the second direction D2 at the fifth position P15 is smaller than the seventh width W2*p*14*b* at the fourth position P14 which is the center (refer to FIG. 6). However, the eighth width W2*p*15*b* may be equal to or larger than the seventh width W2*p*14*b* (refer to 21*ai* in FIG. 6). For example, the outer shape of the first portion 21*a* in the cross section perpendicular to the ejection direction Z may also be the outer shape formed when the two circles are respectively disposed at the positions where the distance between the centers of the circles is smaller than the diameter of the circle, as in the case of the second portion 21*b*.

C6. Another Aspect 6:

In the above embodiment, in the upstream first portion 21*a*, the width of the nozzle 21 in the second direction D2 becomes smaller as the position in the first direction D1 goes from the fourth position P14 to the fifth position P15 (refer to FIG. 6). However, in the upstream first portion 21*a*, the width of the nozzle 21 in the second direction D2 may be larger as the position in the first direction D1 goes from the fourth position P14 to the fifth position P15 (refer to 21*ai* in FIG. 6). The width of the nozzle 21 in the second direction D2 may change, including a decrease and an increase, as the position in the first direction D1 goes from the fourth position P14 to the fifth position P15.

C7. Another Aspect 7:

In the above embodiment, at the fourth position P14 which is the center in the first direction D1, the seventh width W2*p*14*b* of the upstream first portion 21*a* in the second direction D2 is larger than the third width W2*p*14 of the downstream second portion 21*b* in the second direction D2 (refer to the central part in FIG. 6 and FIG. 8). At a position where the position in the first direction D1 is the fifth position P15, the eighth width W2*p*15*b* of the upstream first portion 21*a* in the second direction D2 is larger than the fourth width W2*p*15 of the downstream second portion 21*b* in the second direction D2 (refer to FIGS. 6 and 9).

However, the dimension of the first portion 21*a* in the cross section perpendicular to the ejection direction may be equal to the dimension of the second portion 21*b* or equal to or less than the dimension of the second portion 21*b* at one of the fourth position P14 and the fifth position P15. The dimension of the first portion 21*a* in the cross section perpendicular to the ejection direction may be equal to the dimension of the second portion 21*b* or equal to or less than the dimension of the second portion 21*b* in one of the first direction D1 and the second direction D2.

C8. Another Aspect 8:

In the above embodiment, the difference between the seventh width W2*p*14*b* of the upstream first portion 21*a* in the second direction D2 and the third width W2*p*14 of the downstream second portion 21*b* at the fourth position P14 is larger than the difference between the eighth width W2*p*15*b* of the upstream first portion 21*a* in the second direction D2 and the fourth width W2*p*15 of the downstream second portion 21*b* at the fifth position P15. However, the difference between the seventh width W2*p*14*b* and the third width W2*p*14 may be equal to or less than the difference between the eighth width W2*p*15*b* and the fourth width W2*p*15.

C9. Another Aspect 9:

In the above embodiment, the seventh width W2*p*14*b* of the upstream first portion 21*a* in the second direction D2 at the fourth position P14 and the first width W1*p*23*b* of the first portion 21*a* in the first direction D1 at the third position P23 are equal to each other (refer to FIG. 6). However, the seventh width W2*p*14*b* and the first width W1*p*23*b* may be different (refer to FIG. 10). Note that it is preferable that the seventh width W2*p*14*b* and the first width W1*p*23*b* are substantially equal to each other. The "substantially equal" in the two dimensions means that one dimension is included in a range of 85% to 115% of the other dimension.

C10. Another Aspect 10:

In the second embodiment, the outer shape of the upstream first portion 21*a* is elliptical (refer to FIG. 10). As a result, the seventh width W2*p*14*b* of the first portion 21*a* in the second direction D2 at the fourth position P14, which is the center in the first direction D1, is smaller than the first width W1*p*23*b* of the first portion 21*a* in the first direction D1 at the third position P23, which is the center in the second direction D2. However, the outer shape of the upstream first portion 21*a* may also be an elliptical shape or an oval shape in which the seventh width W2*p*14*b* in the second direction D2 at the fourth position P14 is larger than the first width W1*p*23*b* in the first direction D1 at the third position P23.

C11. Another Aspect 11:

In the above embodiment, in the downstream second portion 21*b*, the second width W1*p*23 in the first direction D1 is larger than the third width W2*p*14 and the fourth width W2*p*15 in the second direction D2 (refer to FIG. 6). However, the second width W1*p*23 in the first direction D1 may be equal to or less than the third width W2*p*14 in the second direction D2, or may be equal to or less than the fourth width W2*p*15 in the second direction D2.

C12. Another Aspect 12:

In the above embodiment, the nozzle 21 has the first portion 21*a* and the second portion 21*b* located downstream of the first portion 21*a* in the ejection direction Z (refer to the lower central portion in FIG. 3). However, the nozzle may, for example, include a third portion between the first portion and the second portion. Another portion may be provided upstream of the first portion.

C13. Another Aspect 13:

In the above embodiment, the tenth width Wz21*b* of the downstream second portion 21*b* in the ejection direction Z is smaller than the ninth width Wz21*a* of the upstream first portion 21*a* in the ejection direction Z (refer to FIGS. 7 to 9). However, the tenth width Wz21*b* of the downstream second portion 21*b* may be equal to or larger than the ninth width Wz21*a* of the upstream first portion 21*a*.

C14. Another Aspect 14:

In the above embodiment, the shape of the first portion 21*a* in the cross section perpendicular to the ejection direction Z is constant regardless of the position in the ejection direction Z. The shape of the second portion 21*b* in the cross section perpendicular to the ejection direction Z is constant regardless of the position in the ejection direction Z (refer to FIGS. 7 to 9). However, the shape of the first portion 21*a* in the cross section perpendicular to the ejection direction Z may differ depending on the position in the ejection direction Z. The shape of the second portion 21*b* in the cross section perpendicular to the ejection direction Z may differ depending on the position in the ejection direction Z.

C15. Another Aspect 15:

In the above embodiment, in the downstream second portion 21*b*, the third width W2*p*14 of the nozzle 21 in the second direction D2 at the fourth position P14 in the first direction D1 is 60% of the fourth width W2*p*15 of the nozzle 21 in the second direction D2 at the fifth position P15 in the first direction D1 (refer to the central part in FIG. 6). However, the third width W2*p*14 may take another value such as 50%, 70%, or 75% of the fourth width W2*p*15. Note that the third width W2*p*14 is preferably larger than ⅙ times the fourth width W2*p*15, further preferably larger than 20%, and still further preferably larger than 30%. The third width W2*p*14 is preferably smaller than ⅔ times the fourth width W2*p*15, further preferably smaller than 65%, and still further preferably smaller than 55%.

C16. Another Aspect 16:

In the above embodiment, the fourth position P14 is the center position in the space in the nozzle 21 in the first direction D1 (refer to FIG. 6). However, the fourth position P14 may be another position in the space in the nozzle 21 in the first direction D1.

C17. Another Aspect 17:

In the above embodiment, the nozzle 21 is provided so as to branch off directly from the first flow path 201 (refer to FIG. 5). However, the nozzle may be coupled to a flow path branching off from the first flow path 201.

C18. Another Aspect 18:

In the above embodiment, the second width W1*p*23 of the downstream second portion 21*b* in the first direction D1 is 80% of the first width W1*p*23*b* of the upstream first portion 21*a* in the first direction D1 (refer to FIG. 6). However, the second width W1*p*23 may take another value such as 90%, 70%, or 60% of the first width W1*p*23*b*. Note that the second width W1*p*23 is preferably larger than ¾ times the first width W1*p*23*b*, and more preferably larger than 78%. The second width W1*p*23 is preferably smaller than 9/10 times the first width W1*p*23*b*, further preferably smaller than 88%, and still further preferably smaller than 85%.

C19. Another Aspect 19:

In the above embodiment, the control unit 121 can execute the first control that drives the piezoelectric actuator 300 such that the liquid is ejected from the nozzle 21 and the second control that drives the piezoelectric actuator 300 such that the liquid is not ejected from the nozzle 21 (refer to FIG. 4). However, the liquid ejection head may also be used in the liquid ejection apparatus in which the second control is not performed.

C20. Another Aspect 20:

In the above embodiment, the control unit 121 drives the piezoelectric actuator 300 in the second control such that the meniscus Mn of the ink in the nozzle 21 reaches the first position Pz1 in the first portion 21*a* (refer to FIGS. 7 and 9). However, the control unit 121 may drive the piezoelectric actuator 300 in the second control such that the meniscus Mn of the ink in the nozzle 21 does not reach the first position Pz1 in the first portion 21*a*.

C21. Another Aspect 21:

In the above embodiment, the control unit 121 performs the different control depending on the ink type in the second control. However, the liquid ejection head may also be used in the liquid ejection apparatus in which the second control, which differs depending on the ink type, is not performed.

C22. Another Aspect 22:

In the above embodiment, the control unit 121 performs the control according to the passage of time in the second control. However, the liquid ejection head may also be used in the liquid ejection apparatus in which the second control according to the passage of time is not performed.

D. Still Another Aspect:

The present disclosure is not limited to the above embodiments and can be realized in various aspects within a scope not departing from the spirit of the present disclosure. For example, the present disclosure can be realized by the following aspects. The technical features in the above embodiments corresponding to technical features in respective aspects described below may be replaced or combined as appropriate, for solving a part or all of the problems of the present disclosure or for achieving a part or all of the effects of the present disclosure. When the technical features are not described as essential in the specification, the features may be deleted as appropriate.

(1) According to an aspect of the present disclosure, a liquid ejection head is provided. The liquid ejection head includes a flow path for a liquid to flow in a first direction, an energy generation element that generates energy for ejecting the liquid, and a nozzle that communicates with the flow path and that ejects the liquid in an ejection direction that intersects the first direction by the energy generated by the energy generation element.

A specific position in the nozzle in the ejection direction is a first position, a specific position in the nozzle that is downstream of the first position in the ejection direction is a second position, a substantially center in the nozzle in a second direction that is a direction intersecting the first direction and the ejection direction is a third position, a specific position in the nozzle in the first direction is a fourth position, and a specific position in the nozzle that is closer to one end of the nozzle in the first direction than is the fourth position is a fifth position.

A width of the nozzle in the first direction at a position where the position in the ejection direction is the first position and the position in the second direction is the third position is a first width, a width of the nozzle in the first direction at a position where the position in the ejection direction is the second position and the position in the second direction is the third position is a second width, a width of the nozzle in the second direction at a position where the position in the ejection direction is the second position and the position in the first direction is the fourth position is a third width, and a width of the nozzle in the second direction at a position where the position in the ejection direction is the second position and the position in the first direction is the fifth position is a fourth width.

The second width is smaller than the first width and the fourth width is larger than the third width.

When the energy is applied to the liquid in the nozzle, the meniscus, which is the interface between the liquid in the nozzle and the outside air, vibrates most at a portion farthest from the inner wall in the nozzle. On the other hand, a portion near the inner wall in the nozzle is less likely to vibrate. Note that a difference between a vibration width of the portion near the inner wall in the nozzle and the vibration width of the portion farthest from the inner wall in the nozzle becomes smaller as the distance between the portion farthest from the inner wall in the nozzle and the inner wall in the nozzle is smaller.

In the above aspect, at the position where the position in the second direction is the third position, the second width at the position where the position in the ejection direction is the second position is smaller than the first width at a certain position where the position in the ejection direction is the first position which is more upstream. Therefore, the following effects are obtained as compared with an aspect in which the second width is larger than the first width. That is, it is possible to efficiently supply the liquid to the nozzle from the upstream flow path toward the opening end of the nozzle and stably eject the liquid from the nozzle in a constant direction.

In the above aspect, at the position where the position in the ejection direction is the second position, the fourth width at the position where the position in the first direction is the fifth position is larger than the third width at a certain position where the position in the first direction is the fourth position which is farther from the end. Therefore, the following effects are obtained as compared with an aspect in which the fourth width is less than the third width. That is, it is possible to reduce the distance between the portion farthest from the inner wall in the nozzle and the inner wall in the nozzle at the position where the position in the ejection direction is the second position. As a result, it is possible to reduce the difference between the vibration width of the portion near the inner wall in the nozzle and the vibration width of the portion farthest from the inner wall in the nozzle, in the meniscus. Therefore, the energy is applied to the liquid in the nozzle to enable also the liquid near the inner wall in the nozzle to flow efficiently. As a result, it is possible to reduce the amount of liquid retained in the nozzle.

(2) In the liquid ejection head according to the above aspect, when a specific position in the nozzle that is closer to the one end of the nozzle in the first direction than is the fifth position is a sixth position and a width of the nozzle in the second direction at a position where the position in the ejection direction is the second position and the position in the first direction is the sixth position is a fifth width, the fifth width may be smaller than the fourth width.

(3) In the liquid ejection head according to the above aspect, at the position where the position in the ejection direction is the second position, (i) the width of the nozzle in the second direction may be larger as the position in the first direction goes from the fourth position to the fifth position, and (ii) the width of the nozzle in the second direction may be smaller as the position in the first direction goes from the fifth position to the sixth position.

(4) In the liquid ejection head according to the above aspect, when a specific position in the nozzle that is closer to the other end of the nozzle in the first direction than is the fourth position is a seventh position and the width of the nozzle in the second direction at a position where the position in the ejection direction is the second position and the position in the first direction is the seventh position is a sixth width, the sixth width may be larger than the third width.

(5) In the liquid ejection head according to the above aspect, when the width of the nozzle in the second direction at a position where the position in the ejection direction is the first position and the position in the first direction is the fourth position is a seventh width and the width of the nozzle in the second direction at a position where the position in the ejection direction is the first position and the position in the first direction is the fifth position is an eighth width, the eighth width may be smaller than the seventh width.

(6) In the liquid ejection head according to the above aspect, at the position where the position in the ejection direction is the first position, the width of the nozzle in the second direction may be smaller as the position in the first direction goes from the fourth position to the fifth position.

(7) In the liquid ejection head according to the above aspect, the seventh width may be larger than the third width, and the eighth width may be larger than the fourth width.

(8) In the liquid ejection head according to the above aspect, a difference between the seventh width and the third width may be larger than a difference between the eighth width and the fourth width.

(9) In the liquid ejection head according to the above aspect, the seventh width and the first width may be substantially equal to each other.

(10) In the liquid ejection head according to the above aspect, the seventh width may be smaller than the first width.

(11) In the liquid ejection head according to the above aspect, the second width may be larger than the third width and the fourth width.

(12) In the liquid ejection head according to the above aspect, the nozzle may include a first portion including the first position and a second portion that includes the second position and that is located downstream of the first portion in the ejection direction, a width of the first portion in the ejection direction may be a ninth width, and a width of the second portion in the ejection direction may be a tenth width.

(13) In the liquid ejection head according to the above aspect, the tenth width may be smaller than the ninth width.

(14) In the liquid ejection head according to the above aspect, in the first portion, the width of the nozzle in the first direction may be constant regardless of the position in the ejection direction; in the first portion, the width of the nozzle in the second direction may be constant regardless of the position in the ejection direction; in the second portion, the width of the nozzle in the first direction may be constant regardless of the position in the ejection direction; and in the second portion, the width of the nozzle in the second direction may be constant regardless of the position in the ejection direction.

(15) In the liquid ejection head according to the above aspect, the third width may be larger than 1/6 times the fourth width and smaller than 2/3 times the fourth width.

(16) In the liquid ejection head according to the above aspect, the fourth position may be a substantially center in the nozzle in the first direction.

(17) In the liquid ejection head according to the above aspect, the nozzle may be provided so as to branch off from the flow path, and the flow path may include a supply flow path portion that is located upstream of a portion where the nozzle is coupled to the flow path and that supplies the liquid to the nozzle and a discharge flow path portion that is located downstream of the portion where the nozzle is coupled to the flow path and that discharges the liquid from the nozzle.

(18) In the liquid ejection head according to the above aspect, the second width may be larger than 3/4 times the first width and smaller than 9/10 times the first width.

(19) According to another aspect of the present disclosure, a liquid ejection apparatus is provided. The liquid ejection apparatus includes the liquid ejection head according to any one of the above aspects, and a drive controller that applies an electric signal to the energy generation element to control driving of the energy generation element. The drive controller is configured to execute a first control to drive the energy generation element such that the liquid is ejected from the nozzle and a second control to drive the energy generation element such that the liquid is not ejected from the nozzle.

With such an aspect, the liquid in the nozzle can flow even in a time interval in which the liquid is not ejected from the nozzle. As a result, it is possible to prevent a situation in which some of the liquid retains in the nozzle for a long period of time.

(20) In the liquid ejection apparatus according to the above aspect, the drive controller, in the second control, may drive the energy generation element such that a meniscus of the liquid in the nozzle reaches the first position.

(21) In the liquid ejection apparatus according to the aspect described above, the drive controller, in the second control, (i) may apply a first electric signal to the energy generation element when a first type of liquid is supplied to the nozzle and (ii) may apply a second electric signal to the energy generation element when a second type of liquid having a higher viscosity than the first type of liquid is supplied to the nozzle. An amount of energy generated when the second electric signal is applied to the energy generation element may be larger than an amount of energy generated when the first electric signal is applied to the energy generation element.

(22) In the liquid ejection apparatus according to the aspect described above, the drive controller, in the second control, (i) may apply a third electric signal to the energy generation element when a cumulative value of a drive time of the energy generation element is a first time and (ii) may apply a fourth electric signal to the energy generation element when the cumulative value of the drive time of the energy generation element is a second time longer than the first time. An amount of energy generated when the fourth electric signal is applied to the energy generation element may be larger than an amount of energy generated when the third electric signal is applied to the energy generation element.

The present disclosure can be implemented in various aspects other than the liquid ejection head and the liquid ejection apparatus. Examples of aspects implementing the present disclosure include a manufacturing method of the liquid ejection head and the liquid ejection apparatus, a control method of the liquid ejection head and the liquid ejection apparatus, a computer program that implements the control method, and a non-transitory storage medium that stores the computer program.

All of the plurality of constituent elements according to each aspect of the present disclosure described above are not essential. It is possible to change or delete a part of the plurality of constituent elements, replace the element with another new constituent element, or partially delete a limited content as appropriate, for solving part or all of the above problems or for achieving part or all of the effects described in the present specification. A part or all of the technical features included in one aspect of the present disclosure described above may be combined with a part or all of the technical features included in another aspect of the present disclosure described above to form an independent aspect of the present disclosure, for solving part or all of the above problems or for achieving part or all of the effects described in the present specification.

What is claimed is:

1. A liquid ejection head comprising:

a flow path for a liquid to flow in a first direction;

an energy generation element that generates energy for ejecting the liquid; and a nozzle that communicates with the flow path and that ejects the liquid in an ejection direction that intersects the first direction by the energy generated by the energy generation element, wherein when a specific position in the nozzle in the ejection direction is a first position, a specific position in the nozzle that is downstream of the first position in the ejection direction is a second position, a substantially center in the nozzle in a second direction that is a direction intersecting the first direction and the ejection direction is a third position, a specific position in the nozzle in the first direction is a fourth position, a specific position in the nozzle that is closer to one end of the nozzle in the first direction than is the fourth position is a fifth position, a width of the nozzle in the first direction at a position where the position in the ejection direction is the first position and the position in the second direction is the third position is a first width, a width of the nozzle in the first direction at a position where the position in the ejection direction is the second position and the position in the second direction is the third position is a second width, a width of the nozzle in the second direction at a position where the position in the ejection direction is the second position and the position in the first direction is the fourth position is a third width, and a width of the nozzle in the second direction at a position where the position in the ejection direction is the second position and the position in the first direction is the fifth position is a fourth width, the second width is smaller than the first width, and the fourth width is larger than the third width.

2. The liquid ejection head according to claim 1, wherein when a specific position in the nozzle that is closer to the one end of the nozzle in the first direction than is the fifth position is a sixth position and a width of the nozzle in the second direction at a position where the position in the ejection direction is the second position and the position in the first direction is the sixth position is a fifth width, the fifth width is smaller than the fourth width.

3. The liquid ejection head according to claim 2, wherein at the position where the position in the ejection direction is the second position, the width of the nozzle in the second direction becomes larger as the position in the first direction goes from the fourth position to the fifth position, and the width of the nozzle in the second direction becomes smaller as the position in the first direction goes from the fifth position to the sixth position.

4. The liquid ejection head according to claim 1, wherein when a specific position in the nozzle that is closer to the other end of the nozzle in the first direction than is the fourth position is a seventh position and the width of the nozzle in the second direction at a position where the position in the ejection direction is the second position and the position in the first direction is the seventh position is a sixth width, the sixth width is larger than the third width.

5. The liquid ejection head according to claim 1, wherein when the width of the nozzle in the second direction at a position where the position in the ejection direction is the first position and the position in the first direction is the fourth position is a seventh width and the width of the nozzle in the second direction at a position where the position in the ejection direction is the first position and the position in the first direction is the fifth position is an eighth width, the eighth width is smaller than the seventh width.

6. The liquid ejection head according to claim 5, wherein at the position where the position in the ejection direction is the first position, the width of the nozzle in the second direction becomes smaller as the position in the first direction goes from the fourth position to the fifth position.

7. The liquid ejection head according to claim 5, wherein the seventh width is larger than the third width, and the eighth width is larger than the fourth width.

8. The liquid ejection head according to claim 7, wherein a difference between the seventh width and the third width is larger than a difference between the eighth width and the fourth width.

9. The liquid ejection head according to claim 5, wherein the seventh width and the first width are substantially equal to each other.

10. The liquid ejection head according to claim 5, wherein the seventh width is smaller than the first width.

11. The liquid ejection head according to claim 1, wherein the second width is larger than the third width and the fourth width.

12. The liquid ejection head according to claim 1, wherein the nozzle includes a first portion including the first position and a second portion that includes the second position and that is located downstream of the first portion in the ejection direction, a width of the first portion in the ejection direction is a ninth width, and a width of the second portion in the ejection direction is a tenth width.

13. The liquid ejection head according to claim 12, wherein the tenth width is smaller than the ninth width.

14. The liquid ejection head according to claim 12, wherein in the first portion, the width of the nozzle in the first direction is constant regardless of the position in the ejection direction, in the first portion, the width of the nozzle in the second direction is constant regardless of the position in the ejection direction, in the second portion, the width of the nozzle in the first direction is constant regardless of the position in the ejection direction, and in the second portion, the width of the nozzle in the second direction is constant regardless of the position in the ejection direction.

15. The liquid ejection head according to claim 1, wherein the third width is larger than ⅙ times the fourth width and smaller than ⅔ times the fourth width.

16. The liquid ejection head according to claim 1, wherein the fourth position is a substantially center in the nozzle in the first direction.

17. The liquid ejection head according to claim 1, wherein the nozzle is provided so as to branch off from the flow path, and the flow path includes a supply flow path portion that is located upstream of a portion where the nozzle is coupled to the flow path and that supplies the liquid to the nozzle and a discharge flow path portion that is located downstream of the portion where the nozzle is coupled to the flow path and that discharges the liquid from the nozzle.

18. The liquid ejection head according to claim 1, wherein the second width is larger than ¾ times the first width and smaller than 9/10 times the first width.

19. A liquid ejection apparatus comprising:

the liquid ejection head according to claim 1; and a drive controller that applies an electric signal to the energy generation element to control driving of the energy generation element, wherein the drive controller is configured to execute a first control to drive the energy generation element such that the liquid is ejected from the nozzle and a second control to drive the energy generation element such that the liquid is not ejected from the nozzle.

20. The liquid ejection apparatus according to claim 19, wherein the drive controller, in the second control, drives the energy generation element such that a meniscus of the liquid in the nozzle reaches the first position.

21. The liquid ejection apparatus according to claim 19, wherein the drive controller, in the second control, (i) applies a first electric signal to the energy generation element when a first type of liquid is supplied to the nozzle and (ii) applies a second electric signal to the energy generation element when a second type of liquid having a higher viscosity than the first type of liquid is supplied to the nozzle, and an amount of energy generated when the second electric signal is applied to the energy generation element is larger than an amount of energy generated when the first electric signal is applied to the energy generation element.

22. The liquid ejection apparatus according to claim 19, wherein the drive controller, in the second control, (i) applies a third electric signal to the energy generation element when a cumulative value of a drive time of the energy generation element is a first time and (ii) applies a fourth electric signal to the energy generation element when the cumulative value of the drive time of the energy generation element is a second time longer than the first time, and an amount of energy generated when the fourth electric signal is applied to the energy generation element is larger than an amount of energy generated when the third electric signal is applied to the energy generation element.

* * * * *